US005701735A

United States Patent [19]

Kawaguchi

[11] Patent Number: 5,701,735

[45] Date of Patent: Dec. 30, 1997

[54] METHOD FOR REGENERATING A PARTICULATE COLLECTION FILTER AND AN EXHAUST EMISSION CONTROL SYSTEM WITH A PARTICULATE COLLECTION FILTER

[75] Inventor: Akio Kawaguchi, Susono, Japan

[73] Assignee: Toyota Jidosha Kabushiki Kaisha, Aichi, Japan

[21] Appl. No.: 507,209

[22] Filed: Jul. 26, 1995

[30] Foreign Application Priority Data

Aug. 8, 1994 [JP] Japan ..... 6-185776

[51] Int. Cl.[6] ..... F01N 3/02; F01N 3/28

[52] U.S. Cl. ..... 60/274; 60/286; 60/296; 60/297; 60/303; 55/466; 55/DIG. 30; 422/169

[58] Field of Search ..... 60/286, 296, 274, 60/303, 311, 297; 55/DIG. 30, 466; 422/169

[56] References Cited

U.S. PATENT DOCUMENTS

| | | | |
|---|---|---|---|
| 2,898,202 | 8/1959 | Houdry | 60/296 |
| 4,386,497 | 6/1983 | Takagi et al. | 60/296 |

FOREIGN PATENT DOCUMENTS

| | | |
|---|---|---|
| 220 588 | 5/1987 | European Pat. Off. . |
| 39 07 939 | 8/1990 | Germany . |
| 41 15 380 | 11/1991 | Germany . |
| 62-210212 | 9/1987 | Japan . |
| 64-41613 | 3/1989 | Japan . |
| 2 084 898 | 4/1982 | United Kingdom . |

OTHER PUBLICATIONS

Patent Abstracts Of Japan, vol. 8 No. 186 (M-320), Aug. 25 1984, JP-A-59 077022, "Exhaust Gas Purifier For Diesel Engine", Tsuji Katsuyuki et al.

Patent Abstracts Of Japan, vol. 8 No. 18 (M-353), Jan. 25, 1985, JP-A-59 165815, "Regenerator For Diesel Particulate Filter", Mitsuhiro Kawagoe.

Patent Abstracts Of Japan, vol. 16 No. 226 (M-1254), May 26, 1992, JP-A-04-043809, "Regenerating Method For Diesel Particulate Filter", Igarashi Tatsuoki.

*Primary Examiner*—Douglas Hart

*Attorney, Agent, or Firm*—Oliff & Berrdige, P.L.C.

[57] ABSTRACT

A method for regenerating a particulate collection filter by the use of a regenerative gas according to the present invention comprises a step for causing particulate combustion in only the downstream part of said filter in the flow of the regenerative gas by the use of the regenerative gas, and a step for causing the particulate combustion in the downstream part of the filter to propagate toward the upstream part of the filter in the flow of the regenerative gas. Therefore, the direction of propagation of the combustion is opposite to the direction of the flow of the regenerative gas so that only part of the particulate combustion heat in each part of the filter is transferred upstream. Accordingly, each part of the filter will not become too hot.

12 Claims, 21 Drawing Sheets

METHOD FOR REGENERATING A PARTICULATE COLLECTION FILTER AND AN EXHAUST EMISSION CONTROL SYSTEM WITH A PARTICULATE COLLECTION FILTER

BACKGROUND OF THE INVENTION

1. Field of the Invention

The present invention relates to a method of regenerating a filter for collecting noxious particulates such as carbon particulates contained in the exhaust from a diesel engine, and an exhaust emission control system having such a particulate collection filter.

2. Description of the Related Art

It is known that as the above mentioned filter, ceramic foam filters, ceramic honeycomb filters, ceramic fiber filters, metal fiber filters, or metal mesh filters, etc. are used. To maintain the particulate collection capacity of a filter and to prevent clogging of the filter, the filter must be regenerated by periodically burning and removing particulates collected in the filter. Accordingly, an exhaust emission control system having a particulate collection filter for a diesel engine usually has a unit for supplying a regenerative gas containing oxygen to burn particulates. This arrangement burns particulates in the filter from the upstream part of the filter in the flow of the regenerative gas toward the downstream part thereof, to thereby regenerate the whole of the filter.

Japanese Unexamined Utility Model Publication No. 64-41613 discloses an exhaust emission control system for a diesel engine, having heaters at the upstream and downstream sides of a filter in a flow of a regenerative gas. To regenerate the filter, the downstream heater is first used to burn particulates in the downstream part of the filter, to let the regenerative gas smoothly pass through the filter. Thereafter, the upstream heater is energized to burn particulates in the upstream part of the filter. The flow of the regenerative gas is actively used to transfer combustion heat toward the downstream part so that particulate combustion is surely propagated from the upstream part to the downstream part and thus the whole of the filter is regenerated.

The usual exhaust emission control system regenerates a filter by propagating particulate combustion from the upstream part of the filter, in a flow of a regenerative gas, toward the downstream part thereof. Accordingly, most of combustion heat produced by the burned particulates is successively transferred to the downstream part by the flow of the regenerative gas and thermal conduction in the filter. The temperature of the downstream end of the filter, therefore, greatly increases due to the heat transferred from the upstream part as well as combustion heat produced by burned particulates in the downstream part. Then, even if the filter is a honeycomb filter having excellent heat resistance, the downstream end thereof can melt or be cracked due to high-temperature thermal stress.

The exhaust emission control system in Japanese Unexamined Utility Model Publication No. 64-41613 actively uses the flow of a regenerative gas to transfer combustion heat of particulates. Since particulates at the downstream end of the filter are burned first to smoothly pass the regenerative gas through the filter, the temperature of the downstream end of the filter will not become too high. However, a part which is close to the downstream end, and in which particulate combustion finishes last becomes too hot, and therefore, this part can melt or be cracked.

SUMMARY OF THE INVENTION

Therefore, an object of the present invention is to provide a method of regenerating a particulate collection filter, and an exhaust emission control system having a particulate collection filter, which is capable of preventing the filter from melting or cracking when the filter is regenerated by burning particulates collected in the filter with the use of a regenerative gas.

According to the present invention there is provided a method for regenerating a particulate collection filter by the use of a regenerative gas comprising: a step for causing particulate combustion at only the downstream part of the filter in the flow of the regenerative gas by the use of the regenerative gas; and a step for causing the particulate combustion in the downstream part of the filter to propagate toward the upstream part of the filter in a flow of the regenerative gas.

Moreover, according to the present invention, there is provided an exhaust emission control system with a particulate collection filter regenerated by the use of a regenerative gas comprising: determining means for determining when the filter must be regenerated; partial combustion means for causing particulate combustion in only the downstream part of the filter in the flow of the regenerative gas; and combustion propagating means for causing the particulate combustion in the downstream part of the filter to propagate toward the upstream part of the filter in the flow of the regenerative gas.

The present invention will be more fully understood from the description of preferred embodiments of the invention set forth below, together with the accompanying drawings.

DESCRIPTION OF THE PREFERRED EMBODIMENTS

Figure 1:
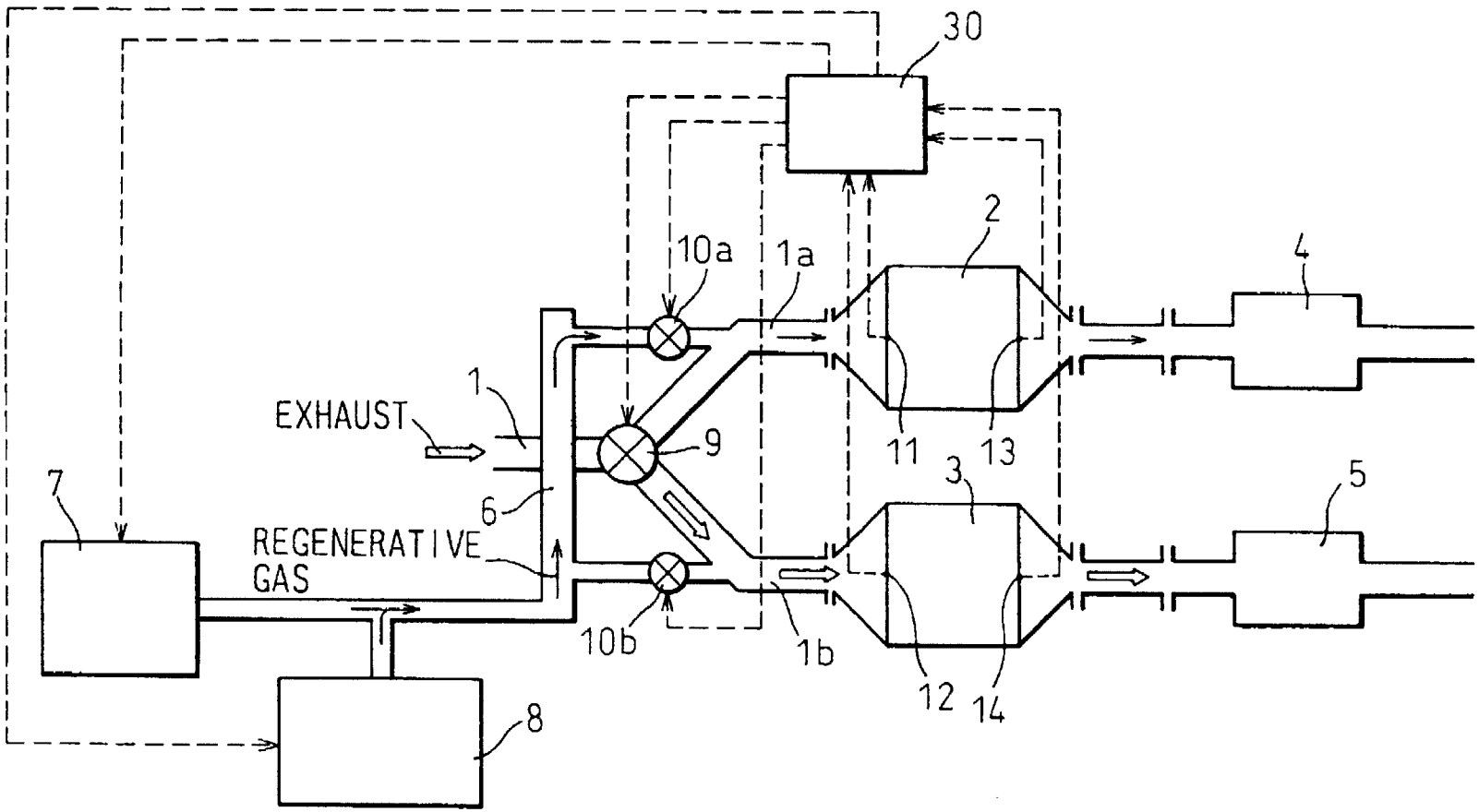
FIG. 1 is a sectional view schematically showing an exhaust emission control system with a particulate collection filter, according to the first embodiment of the present invention.

FIG. 1 is a sectional view schematically showing an exhaust emission control system having a particulate collection filter, according to a first embodiment of the present invention. In this figure, reference numeral 1 is an exhaust pipe connected to an exhaust manifold (not shown) of a diesel engine. The downstream part of the exhaust pipe 1 in the flow of exhaust is branched into first and second branch pipes 1*a* and 1*b*, which are connected to first and second mufflers 4 and 5 which are open to atmosphere, via first and second filters 2 and 3 for collecting particulates, respectively.

The first and second branch pipes 1*a* and 1*b* on exhaust upstream side of the first and second filters 2 and 3 are connected to a secondary air supply unit 7, via a connection pipe 6. A fuel supply unit 8 is connected on the connection pipe 6. The branching point of the exhaust pipe 1 has a changeover valve 9 to connect the exhaust pipe 1 to one of the first and second branch pipes 1*a* and 1*b*. The connection pipe 6 is connected to the first and second branch pipes 1*a* and 1*b* through shut-off valves 10*a* and 10*b*, respectively. The direction of the flow of secondary air supplied to the filters through the connection pipe 6 is the same as that of the exhaust gas.

Figure 2:
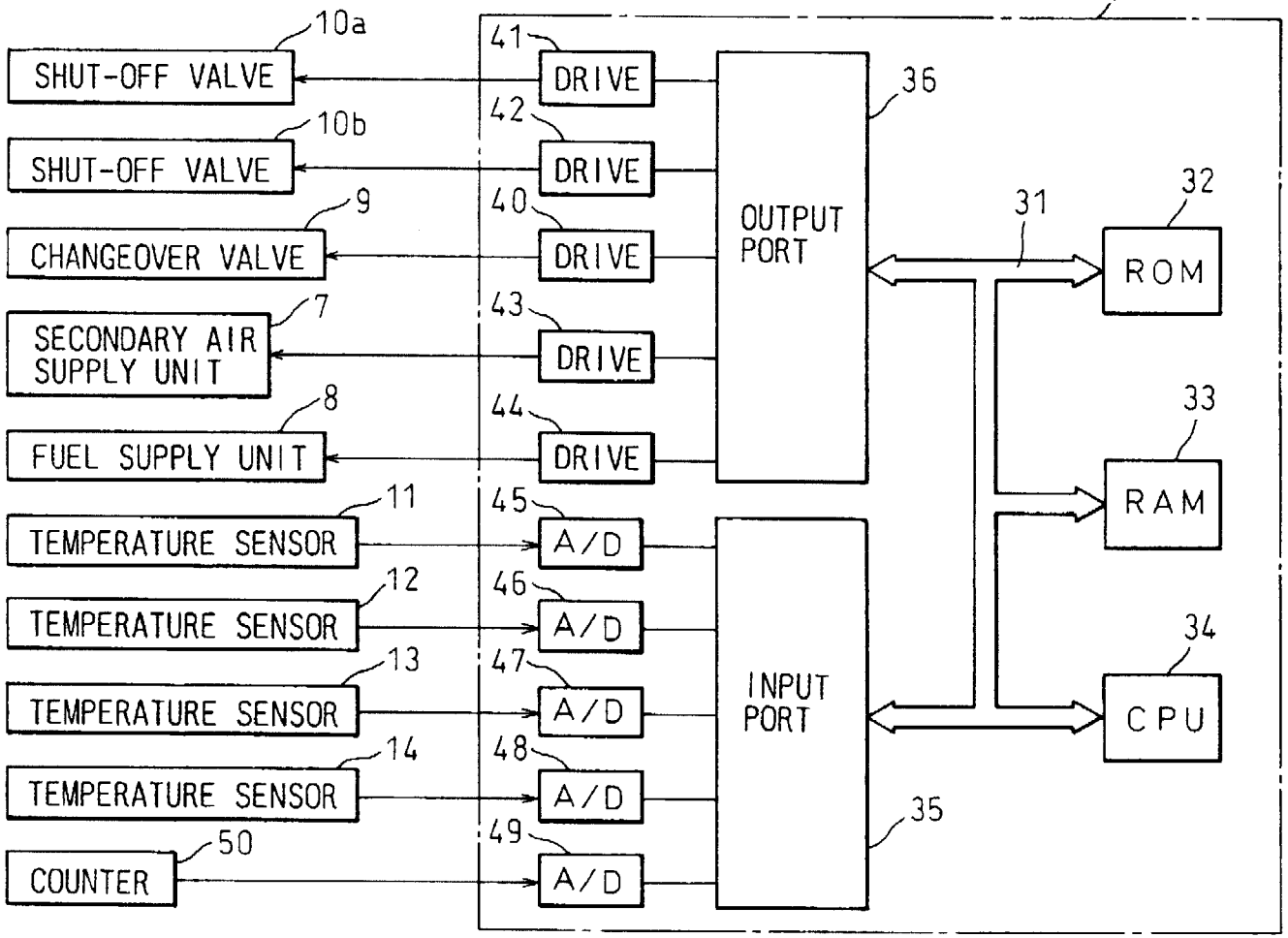
FIG. 2 is a schematic view of the ECU in FIG. 1.

The first and second filters 2 and 3 carry noble metal oxidation catalysts made of, for example, platinum, palladium, or rhodium. Temperature sensors 11, 12, 13, and 14 are arranged upstream and downstream from the filters, to measure the temperatures of the filters. An electronic control unit 30 controls the changeover valve 9, shut-off valves 10*a* and 10*b*, secondary air supply unit 7, and fuel supply unit 8. As shown in FIG. 2, the ECU 30 is constructed as a digital computer and includes a ROM (read only memory) 32, a RAM (random access memory) 33, a CPU (microprocessor, etc.) 34, an input port 35, and an output port 36. The ROM 32, the RAM 33, the CPU 34, the input port 35, and the output port 36 are interconnected by a bidirectional bus 31.

The changeover valve 9, shut-off valves 10*a* and 10*b*, secondary air supply unit 7, and fuel supply unit 8 are connected to the output port 36 of the ECU 30, via each drive circuit 40, 41, 42, 43, and 44, respectively. The temperature sensors 11 to 14 and a counter 50 for counting an engine operation time are connected to the input port 35 via AD converter 45, 46, 47, 48, and 49, respectively.

According to the exhaust emission control system of this arrangement, the changeover valve 9 selects one of the branch pipes. The filter of the selected branch pipe collects particulates contained in exhaust, and the purified exhaust is emitted to the atmosphere through the muffler. As the filter accumulates particulates, the collecting performance of the filter gradually deteriorates. At the same time, the particulates clog the filter so as to increase exhaust resistance. Then, the changeover valve 9 connects the exhaust pipe 1 to the other branch pipe so that the filter connected to this pipe may collect particulates contained in exhaust. The filter whose collecting performance has deteriorated must then be regenerated.

Figure 3:
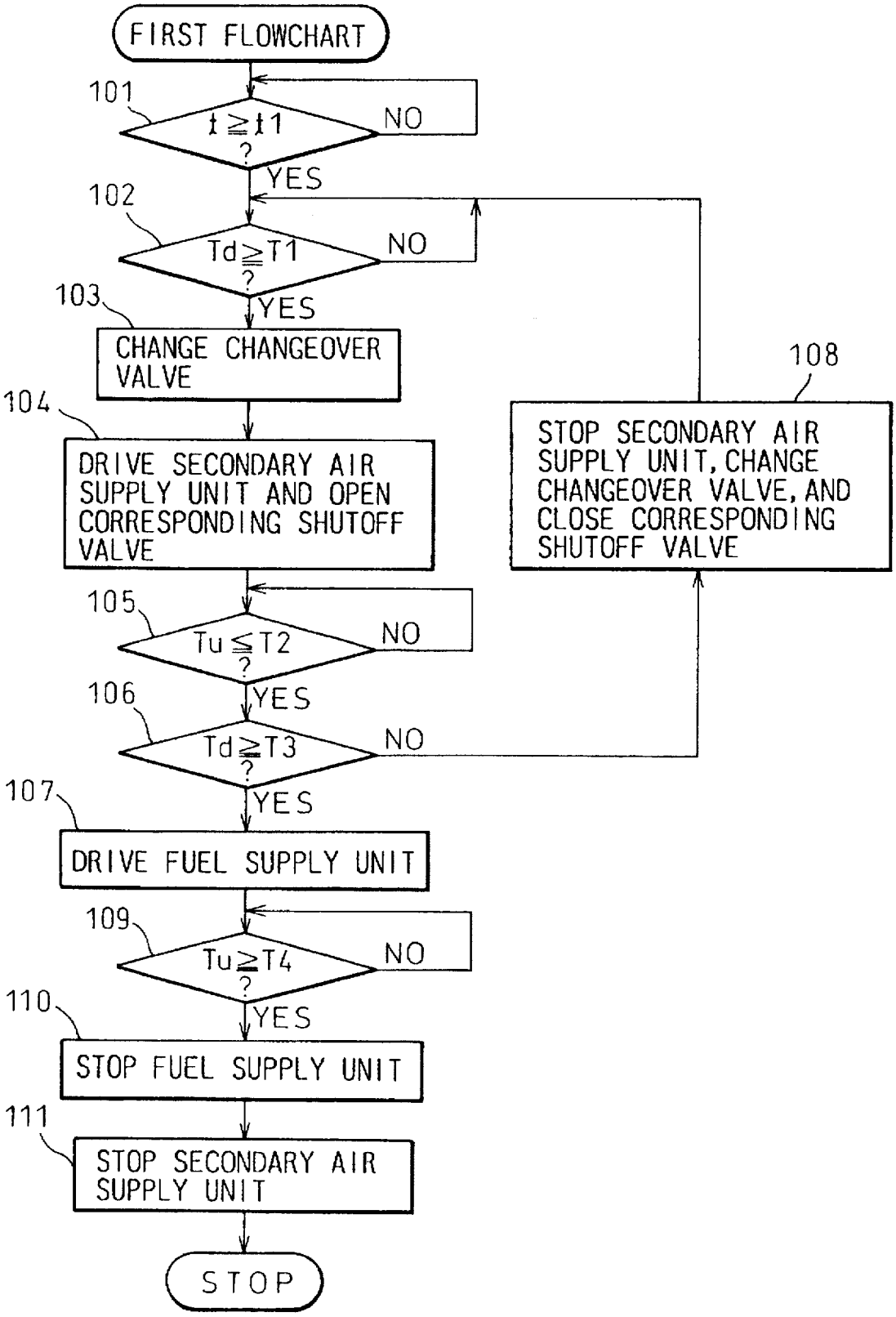
FIG. 3 is a first flowchart showing the steps of regenerating a filter.

FIG. 3 is a first flowchart showing the steps of regenerating a filter carried out by the ECU 30. The first flowchart will be explained on an assumption that the exhaust pipe 1 is connected to the first branch pipe 1*a* and the first filter 2 is collecting particulates contained in the exhaust gas.

At step 101, it is determined whether or not an engine operation time (t) counted by the counter 50 is greater than a predetermined time (t1). During the engine operation time (t), the exhaust pipe 1 is connected to the first branch pipe 1*a*. The time (t1) is set to be a period in which the filter collects a given quantity of particulates. If the step 101 provides a negative answer, it is not necessary to regenerate the first filter 2, and therefore, the step 101 is repeated. If the step 101 provides an affirmative answer, it is nearly time to regenerate the filter, and the flow goes to step 102.

At step 102, the temperature sensor 13 downstream from the first filter 2 is checked to see if the temperature (Td) of the downstream part of the filter is greater than a temperature (T1), which is sufficiently higher than the activation temperature of the catalyst carried by the filter. When it is just after the cold start of the engine, the step 102 provides a negative answer. In this case, the step 102 is repeated until a continuous operation of the engine causes the step 102 to provide an affirmative answer. At step 103 the changeover valve 9 is changed to connect the exhaust pipe 1 with the second branch pipe 1*b*. As a result, the second filter 3 starts to collect particulates from the exhaust gas, and the counter 50 is reset to count an engine operation time (t) for the second filter 3 with the exhaust pipe 1 being connected to the second branch pipe 1*b*.

At step 104, the secondary air supply unit 7 is driven and the shut-off valve 10*a*, arranged between the first branch pipe 1*a* and the connection pipe 6 is opened. On the other hand, when the second filter 3 is regenerated, only the shut-off valve 10*b* is opened. As a result, secondary air is supplied to the upstream part of the first filter 2 in the first branch pipe 1*a* . While passing through the first filter 2, the secondary air removes heat from the upstream part of the filter and conveys the heat to the downstream part thereof, to thereby cool the upstream part of the filter 2.

At step 105 it is determined whether or not the temperature (Tu) of the upstream part of the filter, which is measured by the temperature sensor 11 upstream from the first filter 2, is lower than a temperature (T2) due to the cooling action. The temperature (T2) is set to be somewhat lower than the activation temperature of the catalyst. This step is repeated until the cooling action by the secondary air causes step 105 to provide an affirmative answer. At step 106 it is determined whether or not the temperature (Td) of the downstream part of the filter, which is measured by the temperature sensor 13 downstream from the first filter 2, is higher than a temperature (T3). The temperature (T3) is set to be somewhat higher than the activation temperature of the catalyst and would surely cause fuel ignition if fuel was supplied.

Step 106 usually provides an affirmative answer because at step 102 the temperature of the downstream part of the first filter 2 becomes higher than temperature (T1) that is sufficiently higher than the activation temperature of the catalyst. If step 106 provides a negative answer, at step 108 the secondary air supply unit 7 is stopped, the changeover valve 9 is changed to the other side, and the shut-off valve 10*a* is closed, and thus exhaust is again passed through the first branch pipe 1*a* to heat the first filter 2, and the steps following the step 102 are repeated.

At step 107 the fuel supply unit 8 is driven to mix fuel with the secondary air supplied to the first filter 2. When the fuel reaches the first filter 2, only the downstream part of the first filter 2 causes fuel combustion due to the temperature difference between the upstream and downstream parts of the first filter 2. As a result, the temperature of the particulates in the downstream part of the first filter 2 is increased to an ignition temperature thereof, and the particulates start to burn. At step 109 it is determined whether or not the temperature (Tu) of the upstream part of the filter, which is measured by the temperature sensor 11 upstream from the first filter 2, is greater than a particulate combustion temperature (T4).

Part of the combustion heat of the particulates burned in the downstream part of the first filter 2 is propagated through the first filter 2 toward the upstream part thereof, which has been cooled not so as to cause fuel combustion. As a result, the temperature of the upstream part of the filter rises above the activation temperature of the catalyst to cause fuel combustion and thus the particulates start to burn therein. The remaining combustion heat is propagated downstream by the flow of the secondary air. If step 109 provides an affirmative answer, it is presumed that the particulates in the upstream part of the first filter 2 have been burned so that step 110 stops the fuel supply unit 8 after a small margin of time. At step 111 the secondary air supply unit 7 is stopped after a predetermined period so that no fuel remains in the connection pipe 6 and only secondary air is supplied for cooling the filter.

Figure 4:
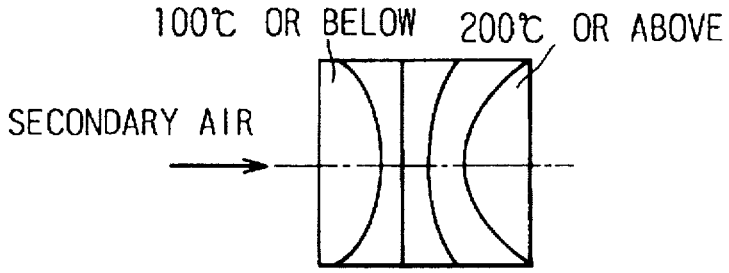
FIG. 4(A) shows a first step in the process of regenerating a filter according to the first flowchart.
FIG. 4(B) shows a second step in the process of regenerating a filter according to the first flowchart.
FIG. 4(C) shows a third step in the process of regenerating a filter according to the first flowchart.
FIG. 4(D) shows a fourth step in the process of regenerating a filter according to the first flowchart.
Figure 4:
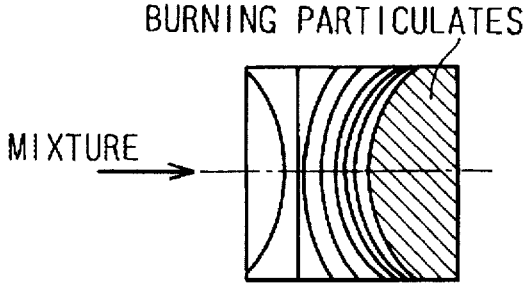
Figure 4:
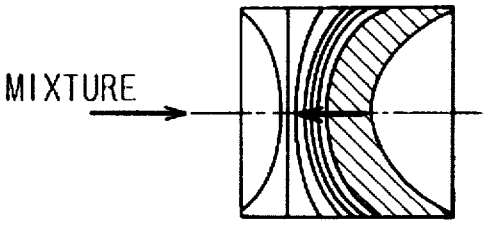
Figure 4:
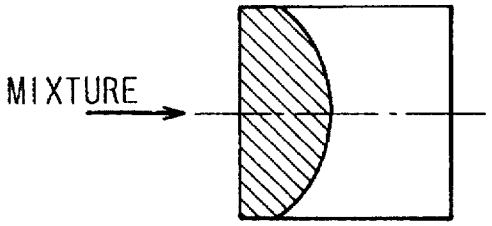

FIGS. 4(A)–4(D) show sectional isothermal charts of a filter in each regenerating condition. FIG. 4(A) corresponds to an affirmative answer at step 106 of the first flowchart. Namely, the temperature of the downstream end of the filter is above the temperature (T3), for example, 200 degrees centigrade that is somewhat greater than the activation temperature of the catalyst. At the same time, the temperature of the upstream end of the filter is below the temperature (T2), e.g., 100 degrees centigrade that is somewhat smaller than the activation temperature of the catalyst. Between the upstream and downstream ends of the filter, the temperature of the filter gradually changes.

FIG. 4(B) corresponds to step 107 of the first flowchart. The fuel supply unit 8 mixes fuel with secondary air, and particulates in the downstream part of the filter start to burn due to fuel combustion. In FIG. 4(C), part of the combustion heat of the particulates burned in the downstream part of the filter is propagated through the filter toward the upstream part thereof. As a result, the upstream part of the filter is heated to the temperature (T3). The remaining part of the combustion heat is propagated downstream by the secondary air, so that the upstream part of the filter will not be excessively heated. In the part of the filter heated to the temperature (T3), particulates start to burn due to fuel combustion. FIG. 4(D) shows that particulates in the upstream part of the filter start to burn due to such propagated combustion.

In the regeneration of a filter mentioned above, the combustion of particulates is propagated from the downstream part toward the upstream part of the filter. Since the direction of propagation of the combustion is opposite to the direction of the flow of a regenerative gas such as secondary air, part of the combustion heat of particulates burned in each part of the filter is transferred upstream, and the remaining part of the combustion heat is transferred downstream by the regenerative gas. Accordingly, each part of the filter will not be heated too much, and no melting or cracks due to thermal stress will occur in the filter.

Figure 5:
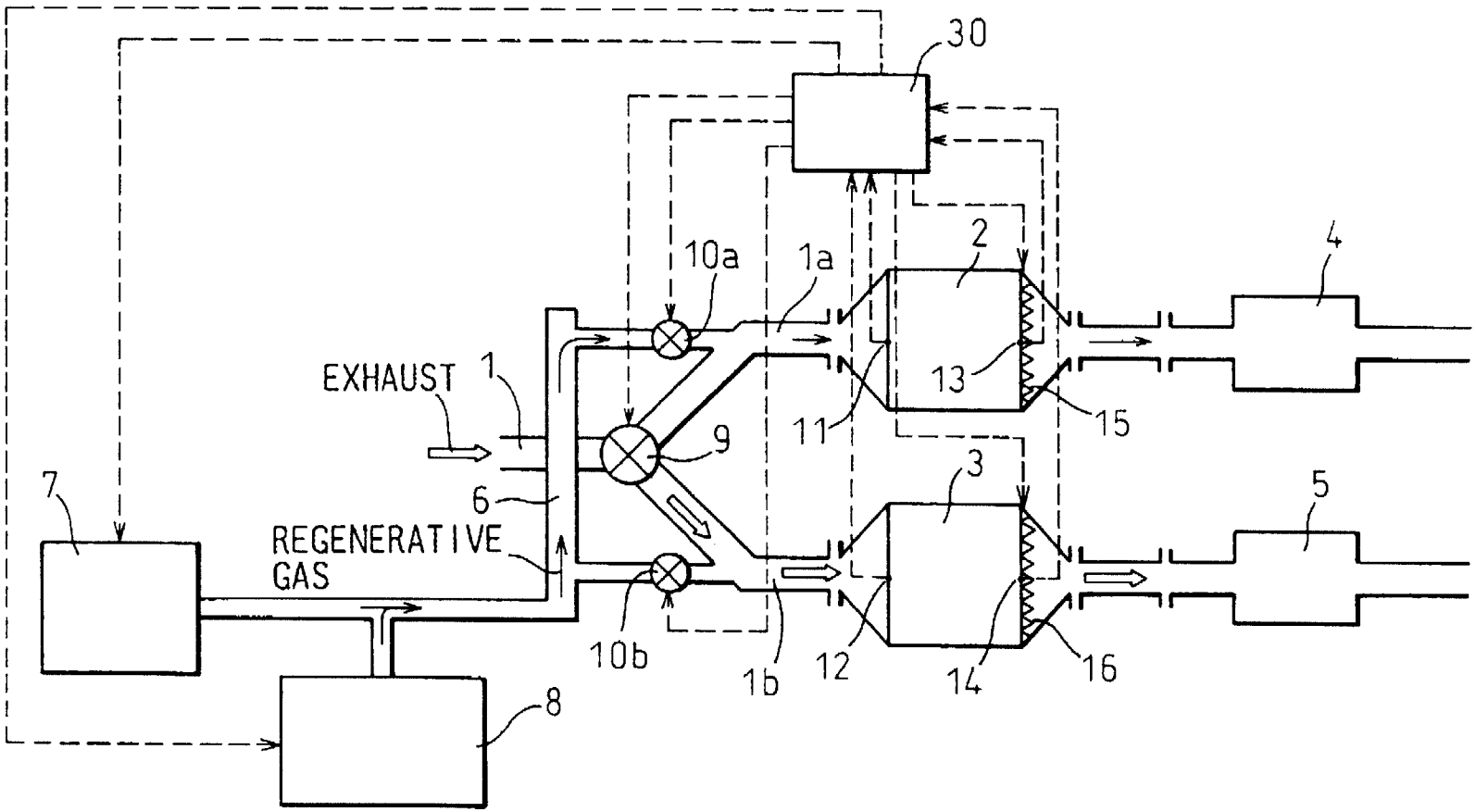
FIG. 5 is a sectional view schematically showing an exhaust emission control system with a particulate collection filter, according to the second embodiment of the present invention.

FIG. 5 is a sectional view schematically showing an exhaust emission control system having a particulate collection filter, according to a second embodiment of the present invention. What is different from the first embodiment is that there are first and second heaters 15 and 16 on the downstream side of first and second filters 2 and 3, respectively, and that the ECU 30 controls the heaters 15 and 16 in addition to a changeover valve 9, shut-off valves 10*a* and 10*b*, secondary air supply unit 7, and fuel supply unit 8.

Figure 6:
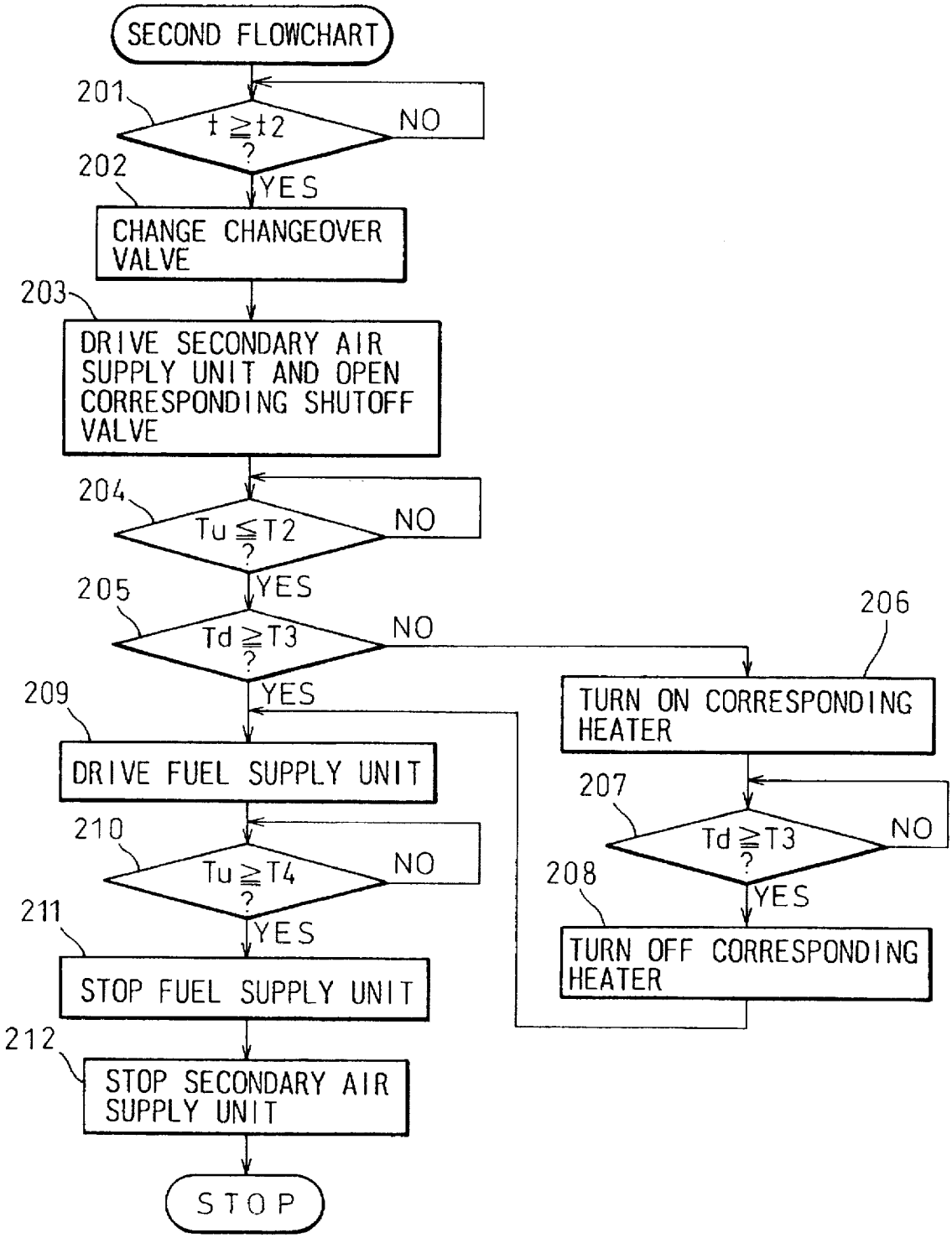
FIG. 6 is a second flowchart showing the steps of regenerating a filter.

FIG. 6 is a second flowchart showing the steps of regenerating a filter carried out by the ECU 30 of the exhaust emission control system of the second embodiment. Similar to the first flowchart, it is supposed that the first filter 2 is collecting particulates contained in exhaust. Step 201 determines whether or not an engine operation time (t) detected by the counter 50 is greater than a predetermined time (t2). In the first flowchart, the active filter continues to collect particulates in exhaust for a while after the step 101 provides an affirmative answer. Accordingly, the regenerative process must be started if the time to regenerate the filter approaches. On the contrary, at step 202 of the second flowchart the changeover valve 9 is changed and the counter is reset as soon as the step 201 provides an affirmative answer. Accordingly, the predetermined time (t2) used by the step 201 may be equal to the time to regenerate the filter.

After step 201 provides an affirmative determination and, at step 202, the changeover valve 9 is changed and the counter 50 is reset, at step 203 a secondary air supply unit 7 is activated and a shut-off valve 10*a* is opened to supply secondary air to the first filter 2. At step 204 it is determined whether or not the temperature (Tu) of the upstream part of the filter, which is measured by a temperature sensor 11 upstream from the first filter 2, is lower than a temperature (T2) due to the cooling effect of the supplied secondary air. The temperature (T2) is set to be somewhat smaller than the activation temperature of the catalyst. This step is repeated until the cooling action by the secondary air causes the step to provide an affirmative answer. At step 205 it is determined whether or not the temperature (Td) of the downstream part of the filter, which is measured by the temperature sensor 13 downstream from the first filter 2, is higher than a temperature (T3). The temperature (T3) is set to be somewhat greater than the activation temperature of the catalyst and would surely cause fuel ignition if fuel was supplied.

If step 205 provides an affirmative answer, step 209 and the following steps corresponding to the steps starting from the step 107 of the first flowchart are carried out. If the step 205 provides a negative answer, at step 206 the first heater 15 is activated to heat the downstream part of the first filter 2. This heating operation is continued until step 207, which is the same as the step 205, provides an affirmative answer. Thereafter, at step 208 the first heater is deactivated, and then the step 209 and the following steps are carried out. Namely, particulate combustion propagates from the downstream part toward the upstream part of the filter to regenerate the filter, similar to the first embodiment.

The second embodiment properly regenerates a filter as in the first embodiment. The second embodiment is capable of regenerating a filter without regard to the temperature of the filter by the minimum use of the heaters. Accordingly, each filter can be used to collect particulates until just before the time to regenerate the filter. This technique extends the filter regeneration interval and prolongs the filter life.

When a filter is heated by exhaust or cooled by secondary air, the temperature of the upstream or downstream part in the filter may be estimated by measuring the temperature of the other part. Accordingly, as a modification of the first embodiment, the upstream temperature sensors 11 and 12, or the downstream temperature sensors 13 and 14 of the first and second filters may be omitted. In this case, the first flowchart is changed such that the determination to be made according to the temperature on the sensor-omitted side is estimated according to the temperature of the other side measured by the sensor. This modification will properly regenerate a filter as in the first embodiment.

Figure 7:
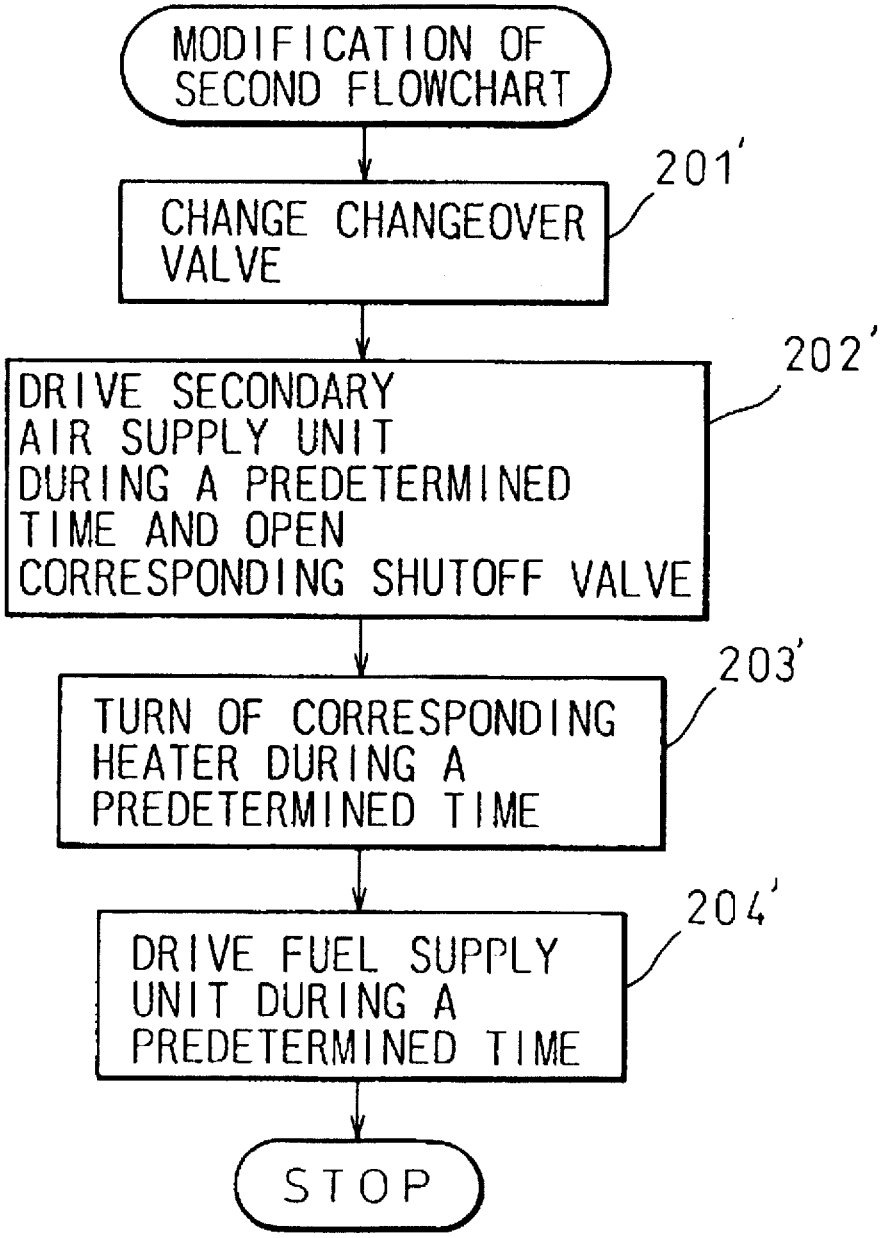
FIG. 7 is a modification of the second flowchart.

A modification of the second embodiment omits all of the temperature sensors 11 to 14. This modification changes the second flowchart as shown in FIG. 7. At the time to regenerate one filter, the changeover valve 9 is changed such that the other filter collects particulates in exhaust. Then, secondary air is supplied to the filter to be regenerated for a period that is considered to be sufficient to decrease the temperature of the upstream part of the filter below the temperature (T2) without regard to the present temperature of the same. Thereafter, the heater is activated for a period that is expected to be sufficient to increase the temperature of the downstream part of the filter above the temperature (T3). Then, the fuel supply unit 8 mixes fuel with the secondary air for a predetermined time. As the result, particulate combustion in the filter propagates from the downstream part toward the upstream part of the filter. This modification properly regenerates a filter as in the second embodiment.

Figure 8:
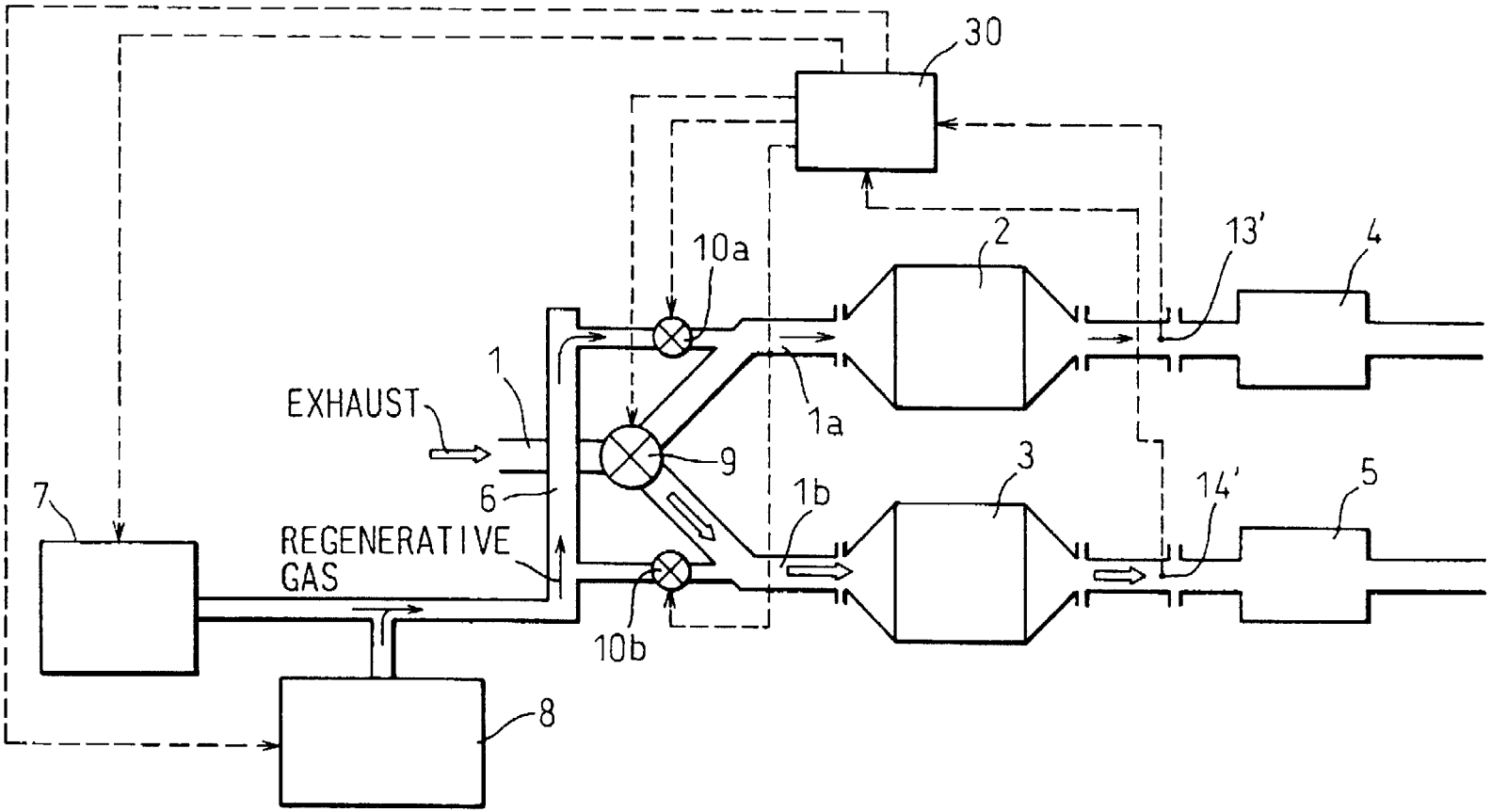
FIG. 8 is a sectional view schematically showing an exhaust emission control system with a particulate collection filter, according to the third embodiment of the present invention.

FIG. 8 is a sectional view schematically showing an exhaust emission control system having a particulate collecting filter, according to a third embodiment of the present invention. What is different from the first embodiment is that temperature sensors 13' and 14' are arranged downstream from first and second filters 2 and 3 in first and second branch pipes 1*a* and 1*b* unlike the first embodiment that arranges the temperature sensors on the upstream and downstream sides of the filters.

As in the first embodiment, in the third embodiment, the upstream part of a filter is sufficiently cooled by secondary air when regenerating the filter. When the temperature of the upstream part of the filter is below the temperature (T2) and when the temperature of the downstream part of the filter is above the temperature (T1), fuel is supplied to the filter so that particulate combustion starts in the downstream part of the filter and this combustion propagates toward the upstream part of the filter. The proper filter regeneration can thus be realized. Before the changeover valve 9 is changed, the temperature of the downstream part of the filter is estimated according to an average of the temperature of exhaust measured by the temperature sensor on the downstream side of the filter for a predetermined time. According to the estimated temperature, it is determined whether or not the changeover valve 9 may be changed to supply secondary air. While the secondary air is being supplied, the temperature of each part of the filter is estimated according to the temperature of the secondary air measured by the same temperature sensor, to determine whether or not fuel may be supplied.

Compared with the first embodiment, the third embodiment is capable of reducing the number of temperature sensors. Since, in the third embodiment, the temperature sensors are not attached to the filter that is heated to a high temperature when particulates are burned, the temperature sensors may be easy to install and will not require high heat resistance, to thereby reduce the cost of the temperature sensors.

Figure 9:
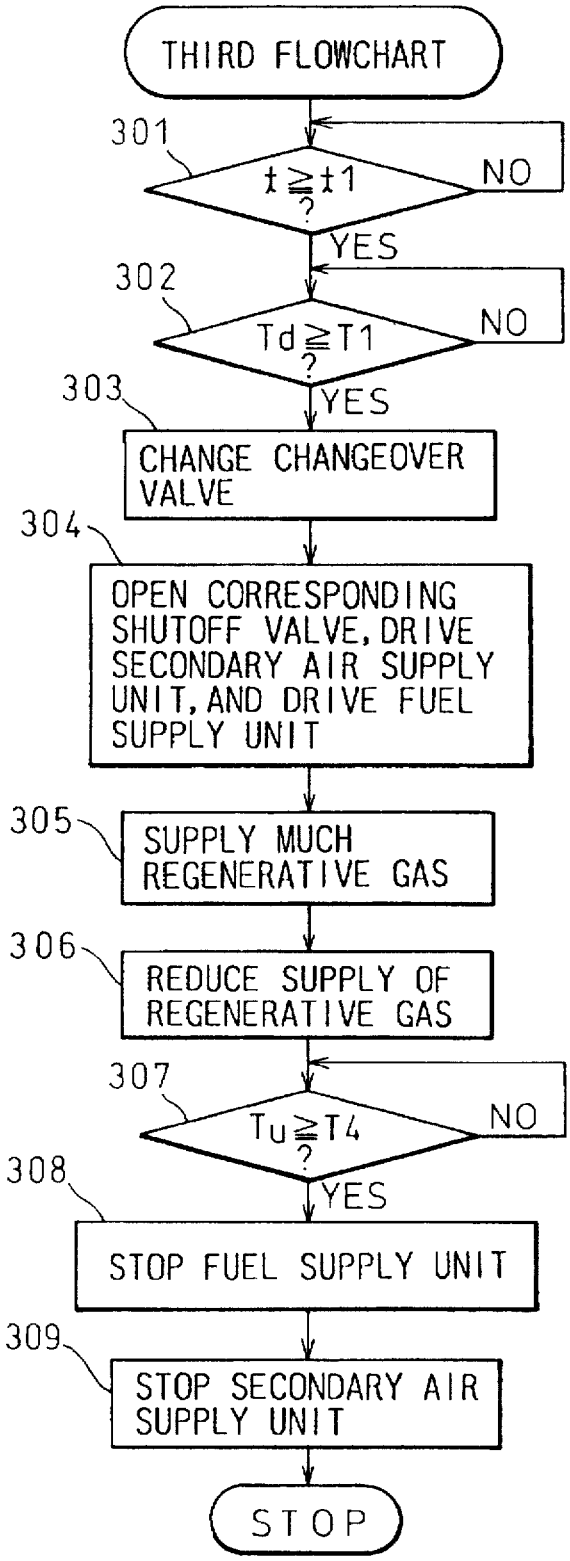
FIG. 9 is a third flowchart showing the steps of regenerating a filter.

The exhaust emission control system having the construction as same as that of the first embodiment may regenerate a filter according to a third flowchart of FIG. 9. Only the difference from the first flowchart will be explained. When it is determined that one of the filters must be regenerated and that the temperature of the downstream part of the filter is above the temperature (T1) by the above mentioned method, the changeover valve 9 is switched to connect the exhaust pipe 1 to the other branch pipe. Thereafter, at step 304 only a corresponding one of the shut-off valves is opened, and the secondary air supply unit 7 and fuel supply unit 8 are driven, to supply a regenerative gas, i.e., a mixture of the fuel and secondary air, of proper ratio, to the filter.

At step 305 the amount of the regenerative gas is set to considerably exceed the proper level for fuel combustion in the filter. When the regenerative gas reaches the upstream part of the filter, since the temperature of the downstream part of the filter is above the temperature (T1), the temperature of the upstream part is also above the activation temperature of the catalyst. Accordingly, the upstream part of the filter starts fuel combustion. The large amount of regenerative gas, however, removes a large quantity of heat from the catalyst of the upstream part of the filter and transfers it downstream. Accordingly, the temperature of the upstream part of the filter does not become sufficient to burn particulates therein. In this way, the large amount of regenerative gas extinguishes the fuel combustion at the upstream part of the filter. On the other hand, a large quantity of heat is not removed from the downstream part of the filter because the regenerative gas heated by the upstream part of the filter reaches the downstream part. As a result, fuel combustion at the downstream part of the filter will not be extinguished, and therefore, the temperature of the downstream part is sufficiently increased to burn the particulates therein.

After a predetermined time, at step 306, the amount of the regenerative gas is decreased to a level that is somewhat larger than a proper level for fuel combustion in the filter. This results in reducing the quantity of combustion heat removed by the regenerative gas from the upstream part of the filter. At the same time, part of the combustion heat of the particulates burned in the downstream part of the filter propagates through the filter toward the upstream part thereof. As a result, the temperature of the upstream part of the filter reaches the combustion temperature of the particulates, to thereby burn the particulates therein.

Figure 10:
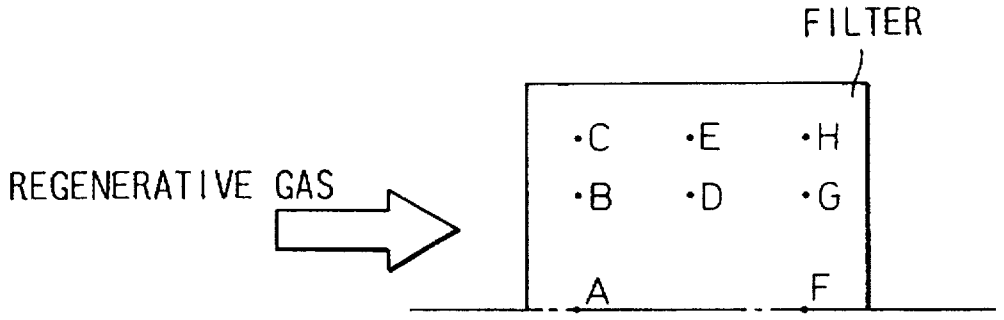
FIG. 10 is a time chart showing temperature changes in each part of a filter according to the third flowchart.
Figure 10:
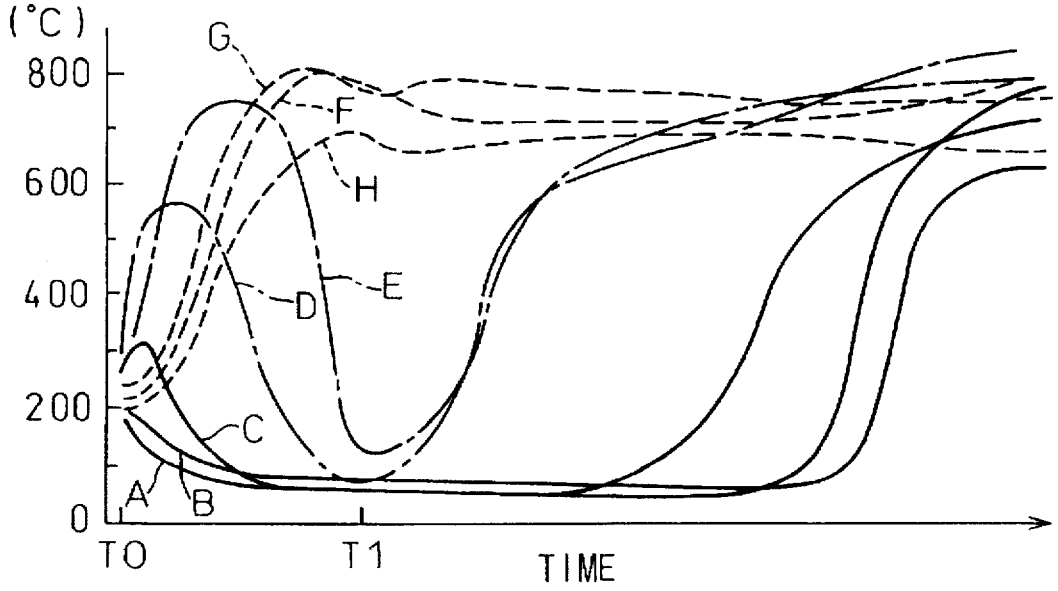

FIG. 10 shows changes in the temperature of each part of a filter during such regeneration of the filter. Continuous lines A, B, and C indicate temperature changes at the center, intermediate, and peripheral positions of the upstream part of the filter, respectively. Dotted lines F, G, and H indicate temperature changes at the center, intermediate, and peripheral positions of the downstream part of the filter, respectively. Dot-and-dash lines D and E indicate temperature changes at the intermediate and peripheral positions of the intermediate part between the upstream and downstream parts of the filter. A large amount of regenerative gas is supplied at time T0 and is reduced at time T1.

When the temperature of each part of the filter is 200 degrees centigrade i.e., somewhat above the activation temperature of the catalyst, and a large amount of regenerative gas is supplied to the filter, each part of the filter starts fuel combustion. At this time, the regenerative gas absorbs much heat from the upstream part of the filter because the temperature of the regenerative gas at the upstream part is nearly equal to the atmospheric temperature. As a result, the temperature of the upstream part of the filter does not increase so as to burn particulates therein. In the intermediate part between upstream and downstream parts of the filter in the flow of the regenerative gas, the regenerative gas contains heat taken from the upstream part of the filter, so that the regenerative gas absorbs little heat from the intermediate part. Accordingly, the temperature of the intermediate part of the filter rises due to fuel combustion. When the temperature of the upstream part of the filter decreases to provide a little heat to be absorbed by the regenerative gas, the quantity of heat absorbed by the regenerative gas from the intermediate part of the filter increases. Then, the temperature of the intermediate part of the filter decreases considerably. Before the temperatures of the upstream part and intermediate part of the filter decreases, the temperature of the downstream part of the filter reaches a temperature of 700 degrees centigrade that is sufficient to burn particulates therein. Accordingly, the particulates in the downstream part of the filter start to burn.

At time (T1), the supply of the regenerative gas is reduced. Then, part of the combustion heat of the particulates in the downstream part of the filter is propagated through the filter to the intermediate part thereof. At the same time, the quantity of heat absorbed by the regenerative gas from the intermediate part decreases, so that the temperature of the intermediate part of the filter increases to burn particulates therein. Thereafter, the temperature of the upstream part of the filter increases in the same manner, to burn particulates therein. In this way, particulate combustion propagates from the downstream part toward the upstream part of the filter, to properly regenerate the filter.

Compared with the first embodiment, the third embodiment does not require the step of cooling the upstream part of the filter, to thereby shorten a filter regeneration time. Cooling the upstream part of the filter can drop the temperature of the downstream part of the filter below the activation temperature of the catalyst. If this happens, the filter must be again heated by exhaust. This problem will never occur in the third embodiment.

Figure 11:
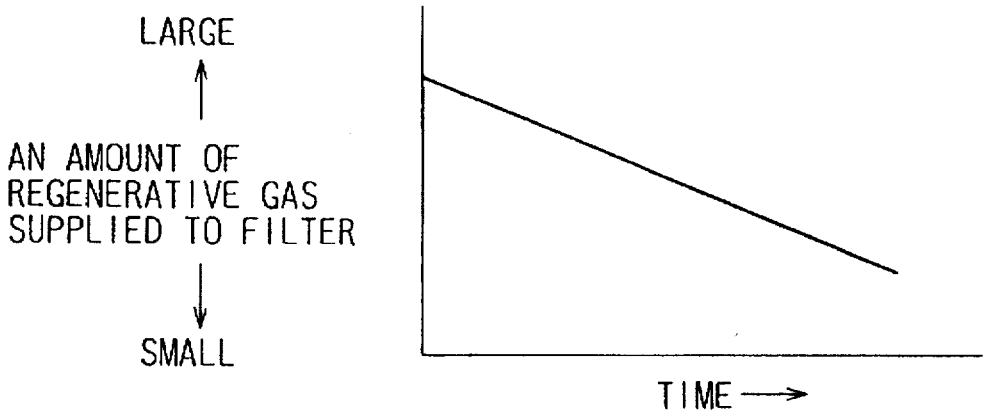
FIG. 11 is a time chart showing changes of an amount of regenerative gas supplied to the filter.

As shown in FIG. 11, a large amount of regenerative gas supplied to a filter in this embodiment may be gradually reduced after a predetermined time, so that particulate combustion can propagate from the downstream part toward the upstream part of the filter in more multiple steps. This technique further restrains an increase in the temperature of each part of the filter during the combustion of the particulates.

Figure 12:
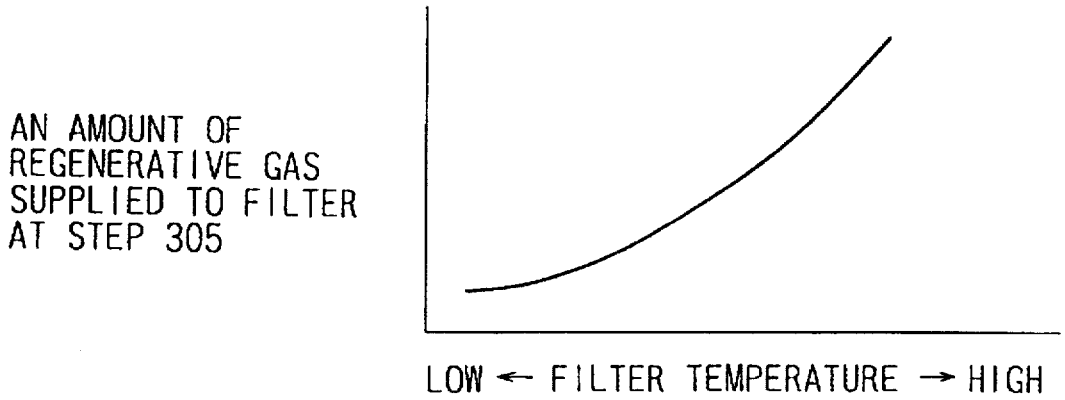
FIG. 12 is a graph showing an amount of regenerative gas supplied to the filter against the initial filter temperature.

In this embodiment, as shown in FIG. 12, the higher the temperature of the filter is, the larger the quantity of regenerative gas supplied to a filter, at first, may be set. In this case, the regenerative gas surely extinguishes the upstream part of the filter even if the temperature thereof is high. In addition, particulates in the downstream part of the filter are surely burned even if the temperature of the part is low. Consequently, this technique surely causes particulate combustion to propagate from the downstream part toward the upstream part of the filter during the regeneration of the filter.

Figure 13:
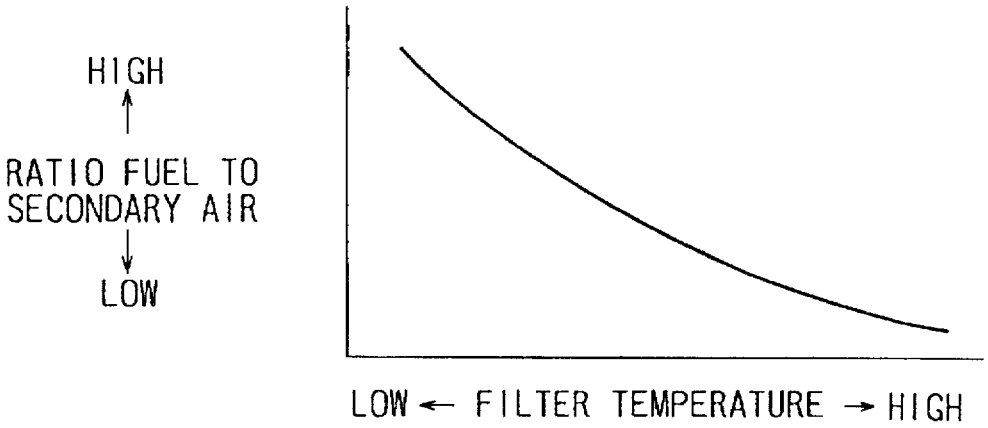
FIG. 13 is a graph showing the ratio of fuel to secondary air against the initial filter temperature.

In this embodiment, as shown in FIG. 13, when supplying a large quantity of regenerative gas containing fuel to a filter for regeneration, higher the temperature of the upstream part of the filter is, the more the ratio of secondary air to fuel in the regenerative gas may be increased. Moreover, the lower the temperature of the downstream part of the filter is, the more the ratio of fuel to secondary air may be increased. This technique will surely causes particulate combustion to propagate from the downstream part toward the upstream part of the filter, in accordance with the temperature of the filter at the start of the regeneration of the filter.

Figure 14:
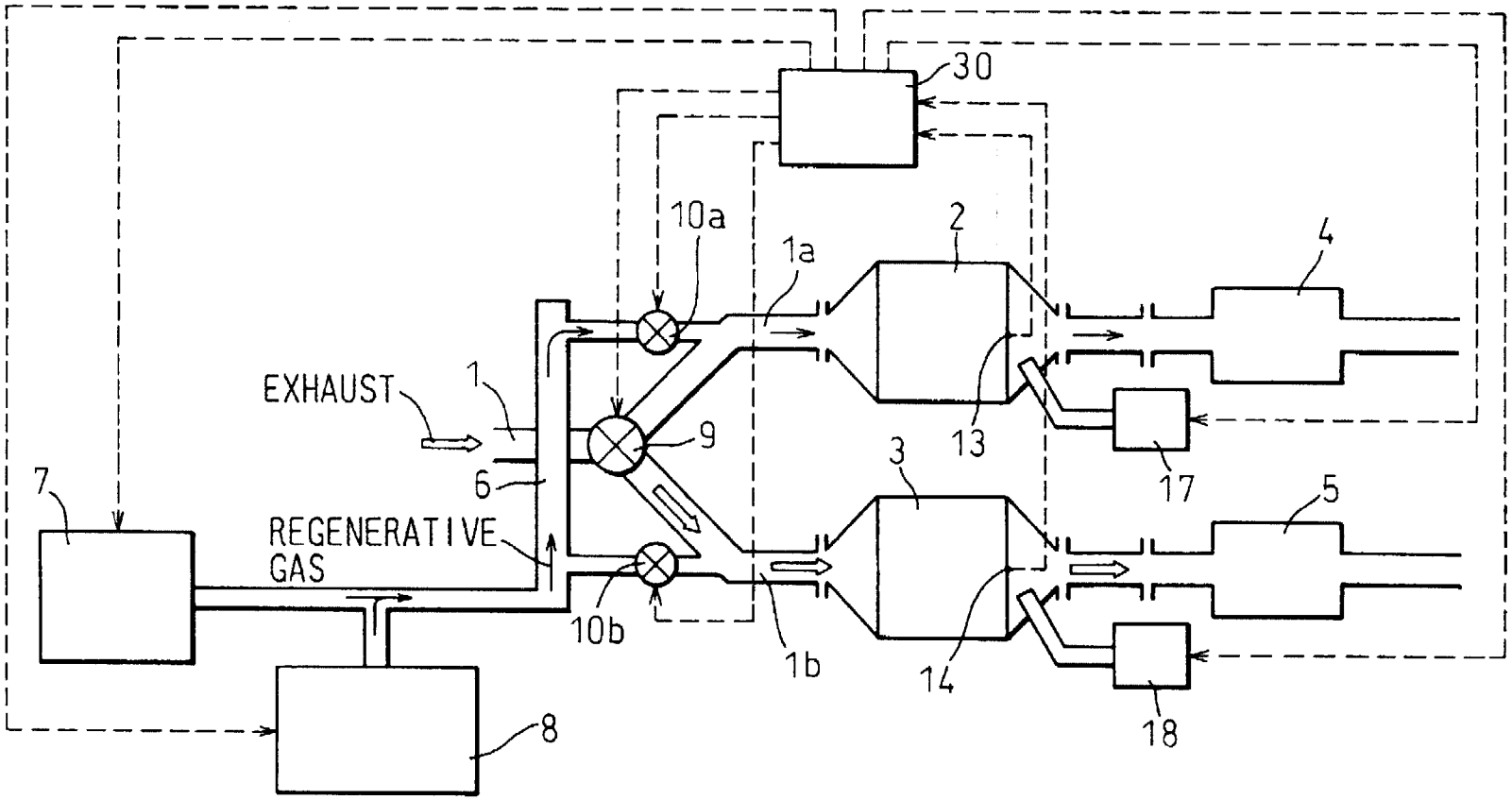
FIG. 14 is a sectional view schematically showing an exhaust emission control system with a particulate collecting filter, according to the fourth embodiment of the present invention.

FIG. 14 is a sectional view schematically showing an exhaust emission control system having a particulate collecting filter, according to a fourth embodiment of the present invention. What is different from the first embodiment is that the temperature sensors 11 and 12 arranged on the upstream side of the first and second filters of the first embodiment are omitted, and that first and second fuel injectors 17 and 18 are arranged to apply fuel to the downstream parts of the first and second filters, respectively.

Figure 15:
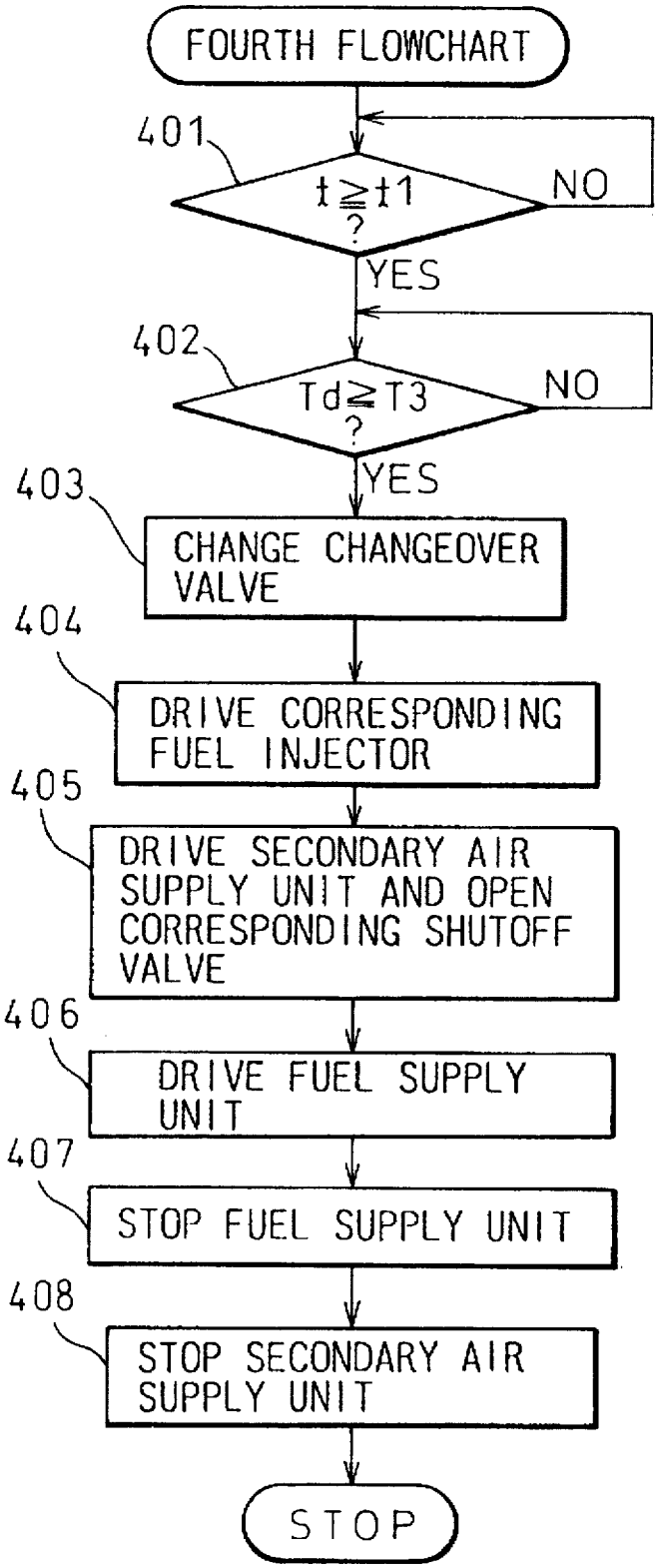
FIG. 15 is a fourth flowchart showing the steps of regenerating a filter.

FIG. 15 is a fourth flowchart showing the steps of regenerating a filter carried out by a ECU 30 of the exhaust emission control system of the fourth embodiment. If, at step 401, it is determined to be close to the time to regenerate one of the filters, at step 402 the temperature of the downstream part of the filter is measured by a corresponding temperature sensor and it is determined if the temperature is above a temperature (T3) which is somewhat greater than the activation temperature of a catalyst.

If the determination is negative, the step 402 is repeated until it provides an affirmative determination after the continuous operation of an engine. At step 403 a changeover valve 9 is changed to connect an exhaust pipe 1 with the other branch pipe so that the other filter may collect particulates in exhaust. At the same time, a counter 50 for counting an engine operation time is reset to start counting an engine operation time (t) for the branch pipe to which the exhaust pipe 1 is presently connected. At step 404 a corresponding one of the fuel injectors is driven to apply fuel to the downstream part of the filter and fuel sticks to only the downstream part of the filter, and step 405 is carried out.

At step 405 a secondary air supply unit 7 is driven and only a corresponding shut-off valve to supply secondary air to the filter in question is opened. At this time, the temperature of the whole part of the filter can be above the catalytic activation temperature. Even if it is true, fuel combustion starts only from the downstream part of the filter because the fuel has been applied only thereto. Accordingly, the temperature in the downstream part of the filter rises to burn particulates therein, and particulate combustion starts therein.

Next, at step 406 a fuel supply unit 8 is driven to mix fuel with the secondary air. At this time, the temperature of the upstream part of the filter can be below the catalytic activation temperature due to the supply of the secondary air. Even if it is true, part of the combustion heat of the particulates in the downstream part of the filter is propagated to the upstream part, to cause fuel combustion in the upstream part and thus particulate combustion starts therein. Consequently, particulates in the filter are burned from the downstream part toward the upstream part of the filter during the regeneration of the filter. When the time for completing the combustion of the particulates in the downstream part of the filter elapses, at step 407 the fuel supply unit 8 is stopped, and thereafter, at step 408, the secondary air supply unit 7 is stopped.

Compared with the first embodiment, the exhaust emission control system according to the fourth embodiment does not require the upstream part of a filter to be cooled in the regeneration of the filter, to thereby shorten a filter regeneration time. The fourth embodiment may employ a single fuel injector that is switched by, for example, a changeover valve to apply fuel to the downstream part of one of the filters.

Figure 16:
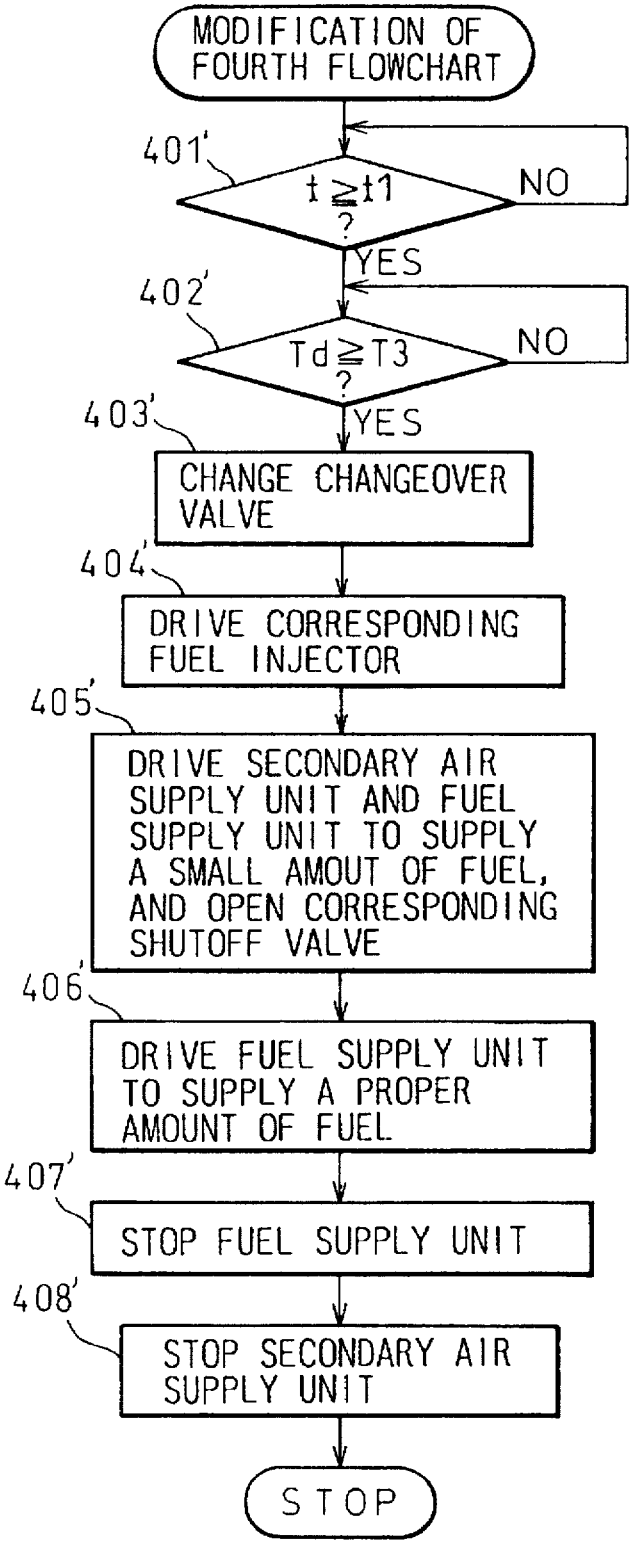
FIG. 16 is a modification of the fourth flowchart.

As shown in a modification of the fourth flowchart in FIG. 16, after the fuel injector is driven, the secondary air supply unit 7 as well as fuel supply unit 8 may be driven to mix a little fuel with secondary air such that partial fuel combustion is caused in the upstream part of the filter. As a result, fuel combustion in the upstream part of the filter is insufficient, and therefore, the temperature of the upstream part of the filter is maintained close to the catalytic activation temperature. At this time, particulates in the downstream part of the filter are burned, and part of the combustion heat of the particulates in the downstream part is propagated to the upstream part thereof to quickly increase the temperature of the upstream part above the catalytic activation temperature. Thereafter, the ratio of fuel to secondary air is set to a proper value to cause fuel combustion and thus particulate combustion starts in the upstream part of the filter. This technique quickly burns particulates in a filter from the downstream part toward the upstream part of the filter during the regeneration of the filter.

This modification further shortens the filter regeneration time and reduces a temperature change in the upstream part of a filter to thereby improve the durability of the filter.

Figure 17:
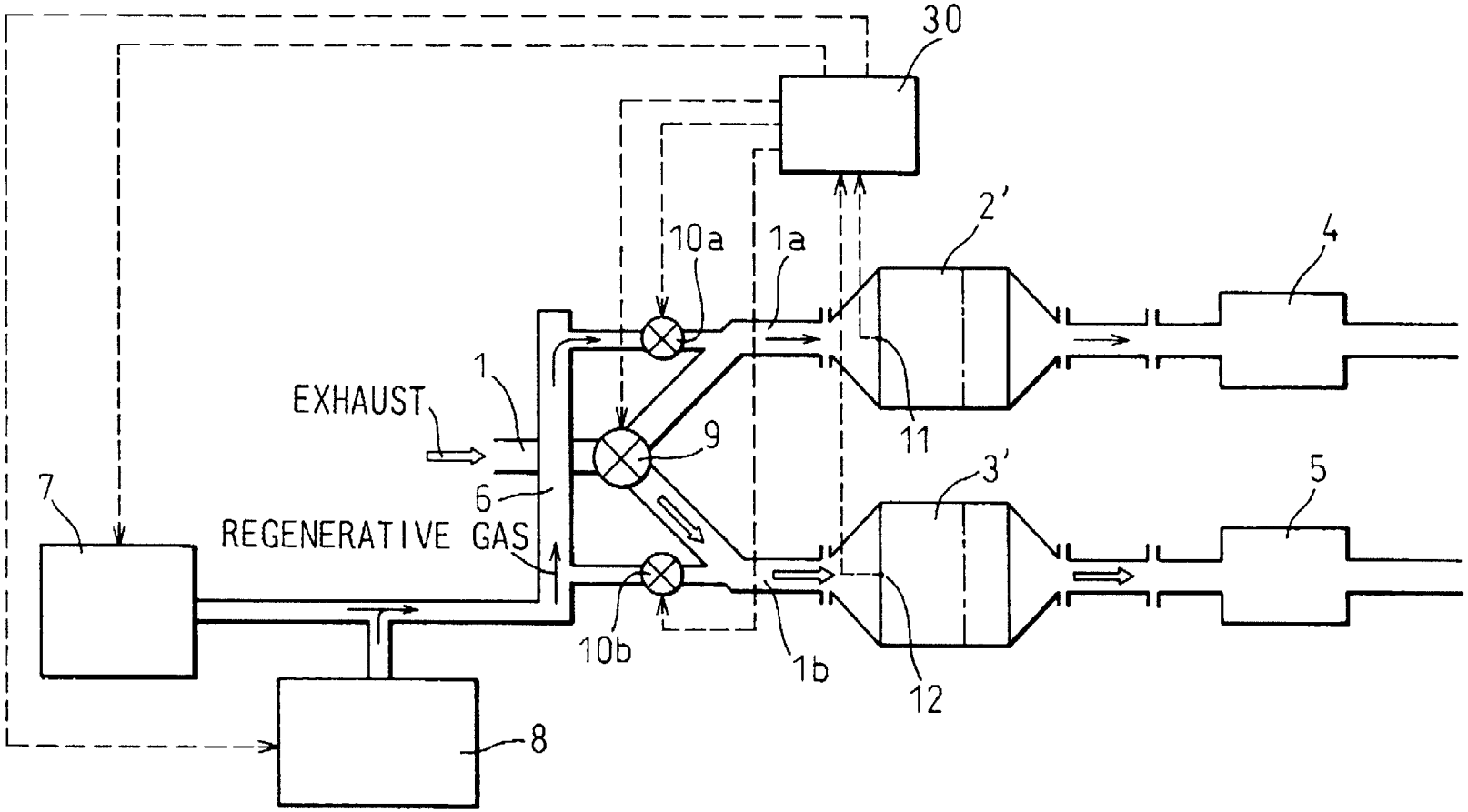
FIG. 17 is a sectional view schematically showing an exhaust emission control system with a particulate collecting filter, according to the fifth embodiment of the present invention.

FIG. 17 is a sectional view schematically showing an exhaust emission control system having a particulate collecting filter according to a fifth embodiment of the present invention. Similar to the first embodiment, the exhaust emission control system of the fifth embodiment has a secondary air supply unit 7 and a fuel supply unit 8, and temperature sensors 11 and 12 for measuring the temperatures of the upstream parts of first and second filters 2' and 3'. Each of the first and second filters 2' and 3' carry a high-temperature-active catalyst made of, for example, palladium, at the upstream part thereof, and a low-temperature-active catalyst made of, for example, platinum, at the downstream part thereof.

Figure 18:
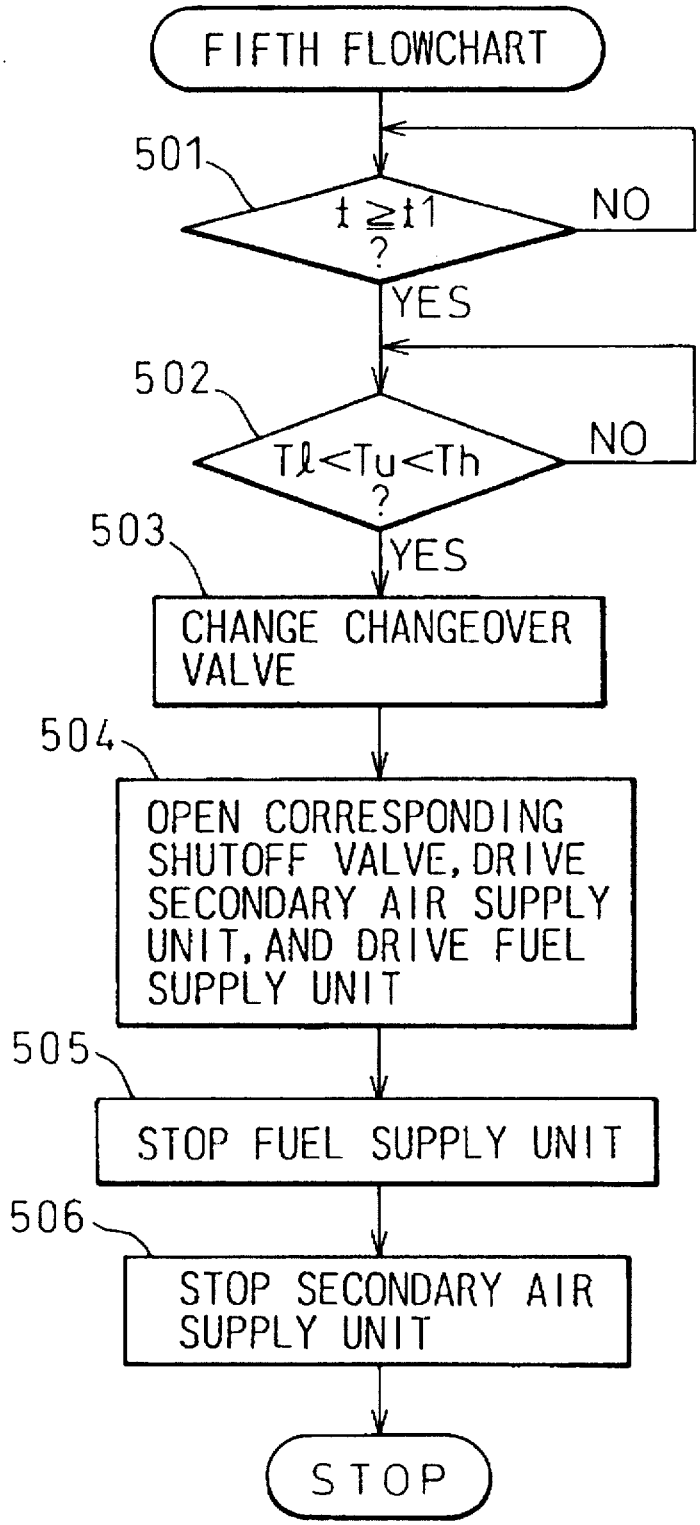
FIG. 18 is a fifth flowchart showing the steps of regenerating a filter.

FIG. 18 is a fifth flowchart showing the steps of regenerating a filter carried out by a ECU 30 of the exhaust emission control system of the fifth embodiment. When, at step 501, it is determined to be close to the time to regenerate one of the filters, at step 502 the temperature of the upstream part of the filter is measured by the use of a corresponding one of the temperature sensors and it is determined whether or not the measured temperature is below the activation temperature (Th) of the high-temperature-active catalyst and above the activation temperature (T1) of the low-temperature-active catalyst.

If the determination is negative, the step 502 is repeated until it provides an affirmative determination due to a change in the engine operating conditions. Next, at step 503 a changeover valve 9 is changed to connect an exhaust pipe 1 with the other branch pipe so that the other filter may collect particulates in exhaust. At the same time, a counter 50 for counting an engine operation time is reset to start counting an engine operation time (t) for the branch pipe to which the exhaust pipe 1 is presently connected.

At step 504 a corresponding shut-off valve is opened and a secondary air supply unit 7 and fuel supply unit 8 are driven to supply a regenerative gas that is a mixture of secondary air and fuel at proper ratio to the filter. If the filter as a whole has a substantially uniform temperature, the temperature of the downstream part of the filter is above the activation temperature (T1) of the low-temperature-active catalyst to cause fuel combustion. As a result, fuel combustion occurs and thus particulate combustion in the downstream part of the filter starts, and part of the combustion heat of the particulates is propagated to the upstream part of the filter so that the upstream part is heated above the activation temperature (Th) of the high-temperature-active catalyst. As a result, the upstream part of the filter causes fuel combustion so that particulate combustion starts therein. After a time for completing the burning of the particulates in the upstream part of the filter, at step 505 the fuel supply unit 8 is stopped, and thereafter, at step 506 the secondary air supply unit 7 is stopped.

The fifth embodiment employs different kinds of catalyst in the upstream and downstream parts of a filter, in which the activation temperature of the catalyst in the downstream part of the filter is lower than that of the catalyst in the upstream part of the filter. If the temperature of the whole of the filter is between the two activation temperatures of the catalysts, it is not necessary to cool the upstream part of the filter when a filter regeneration time comes. This results in shortening a regeneration time. The filters of this embodiment are applicable to any one of the first to fourth embodiments. Therefore, the allowable temperature range of a filter is expanded and thus the need of employing precise temperature sensors is eliminated, to thereby reduce the cost of the exhaust emission control system.

Figure 19:
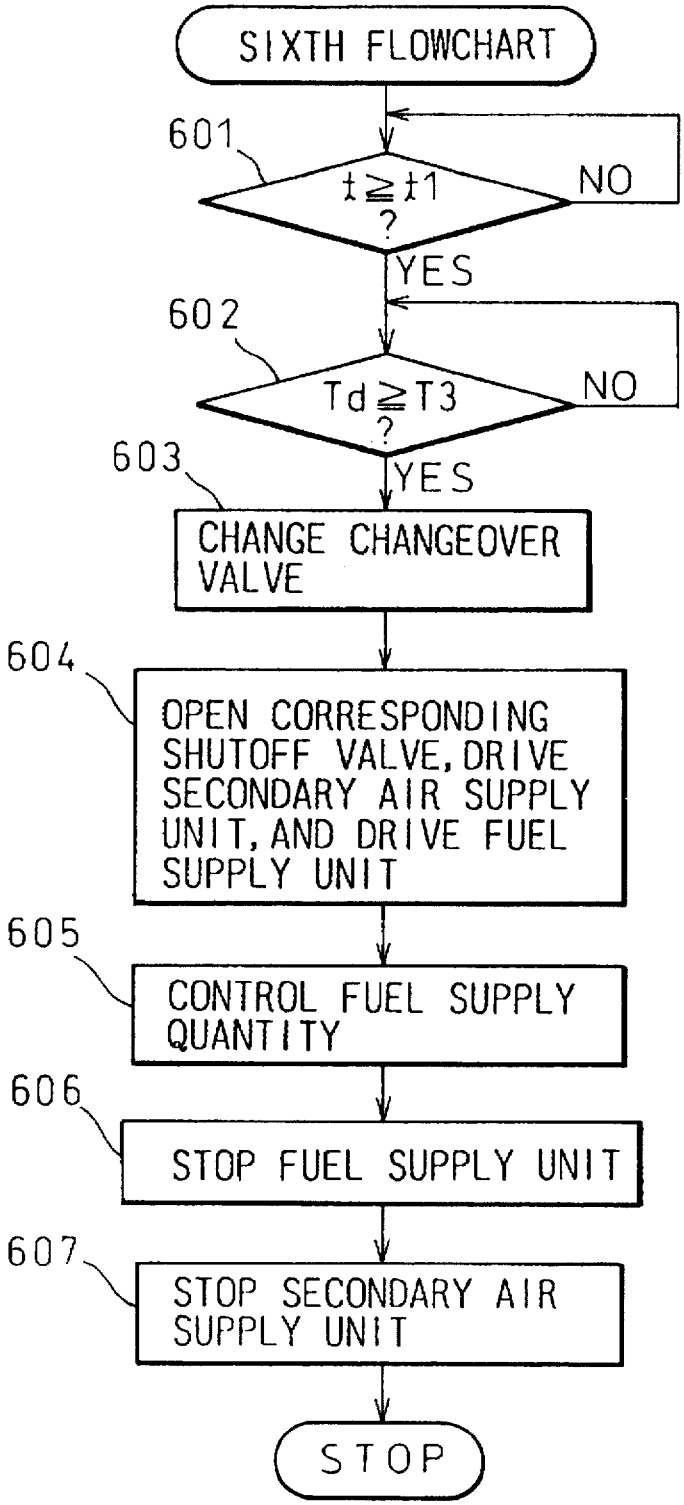
FIG. 19 is a sixth flowchart showing the steps of regenerating a filter.

An exhaust emission control system having a construction the same as that of the first or the third embodiment may regenerate a filter according to a sixth flowchart of FIG. 19. Only the difference from the first flowchart will be explained. When one of the filters is regenerated and when the temperature of the downstream part of the filter is above the temperature (T3) that is somewhat higher than the catalytic activation temperature, by any of the above mentioned ways, the changeover valve 9 changes the exhaust pipe 1 to the other branch pipe. Thereafter, at step 604 of the sixth flow chart a corresponding one of the shut-off valves is opened and the secondary air supply unit 7 and fuel supply unit 8 are driven.

Figure 20:
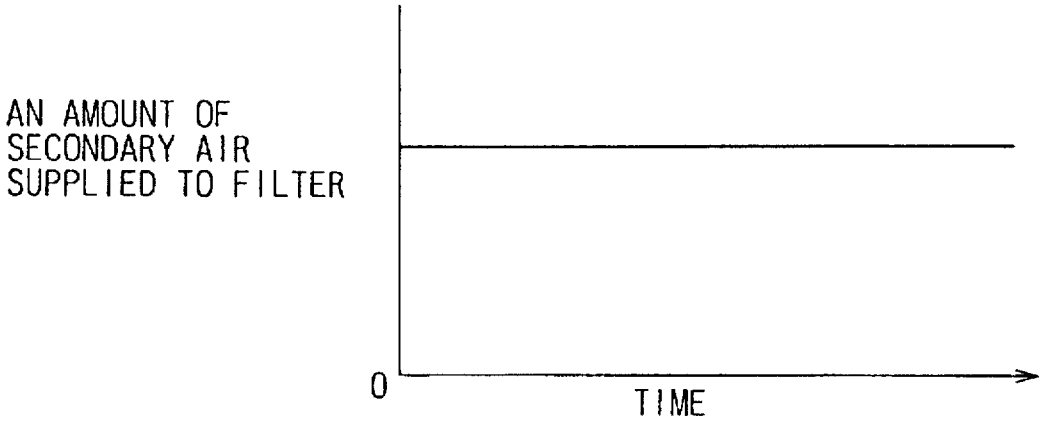
FIG. 20 is a time chart showing an amount of secondary air supplied to the filter.
Figure 21:
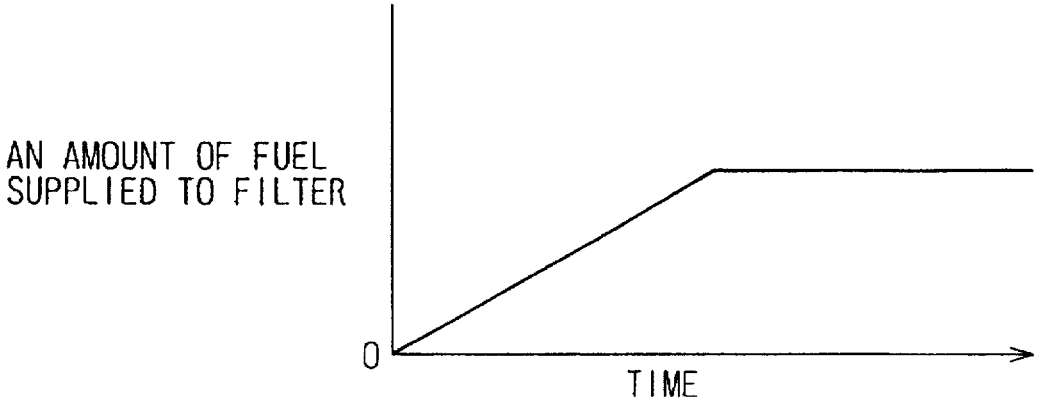
FIG. 21 is a time chart showing an amount of fuel supplied to the filter.

At this time, secondary air supplied by the secondary air supply unit 7 is maintained at a quantity proper for catalytic combustion as shown in FIG. 20. On the other hand, at step 605 fuel supplied by the fuel supply unit 8 is gradually increased to a quantity proper for catalytic combustion as shown in FIG. 21. Such regenerative gas reaches first the upstream part of the filter. Since the temperature of the downstream part of the filter is above (T1), the temperature of the upstream part of the filter is above the catalytic activation temperature. The upstream part of the filter, however, does not provide sufficient fuel combustion due to a lack of fuel. Therefore, the quantity of heat absorbed by the regenerative gas from the upstream part is greater than fuel combustion heat at the upstream part, to lower the temperature of the upstream part.

On the other hand, the downstream part of the filter causes insufficient fuel combustion due to a lack of fuel at first, similar to the upstream part of the filter. Since the regenerative gas reaching the downstream part of the filter contains heat absorbed from the upstream part, the regenerative gas removes a little heat from the downstream part. Accordingly, the temperature of the downstream part of the filter does not drop quickly from the temperature (T3). As time passes, the supply of fuel gradually increases, and the temperature of the downstream part of the filter gradually increases according to fuel combustion progresses. When the supply of fuel becomes proper for fuel combustion, the temperature of the downstream part of the filter becomes sufficient to burn particulates. As a result, particulates in the downstream part of the filter start to burn.

Part of the combustion heat of the particulates in the downstream part of the filter is propagated through the filter toward the upstream part thereof, to increase the temperature of the upstream part to the catalytic activation temperature. At this time, the regenerative gas contains fuel and secondary air proper for fuel combustion so that sufficient fuel combustion occurs in the upstream part of the filter and thus particulate combustion starts therein. In this embodiment, when proper particulate combustion from the downstream part toward the upstream part of the filter is realized, the upstream part of the filter is cooled by the secondary air and at the same time insufficient fuel combustion occurs therein. Accordingly, a change in the temperature of the upstream part of the filter is small as compared with the first embodiment so that the durability of the filter is improved.

Figure 22:
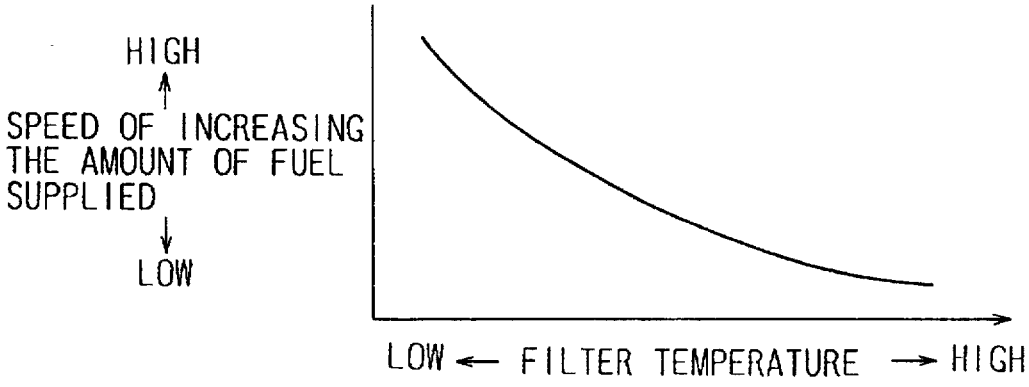
FIG. 22 is a graph showing a speed of increasing the amount of fuel supplied to the filter against the initial filter temperature.

In this embodiment, as shown in FIG. 22, the higher the temperature of a filter is, during regeneration, the more slowly the amount of fuel supplied may be increased. Therefore, when the temperature of the filter is high, the time until the amount of fuel reaches a proper level is prolonged so that the upstream part of the filter is properly cooled during the elongated time. On the other hand, when the temperature of the filter is low, the upstream part of the filter does not need to be cooled for a long time. In this case, the time until an amount of fuel reaches a proper level is shortened so that a regeneration time becomes very short.

Figure 23:
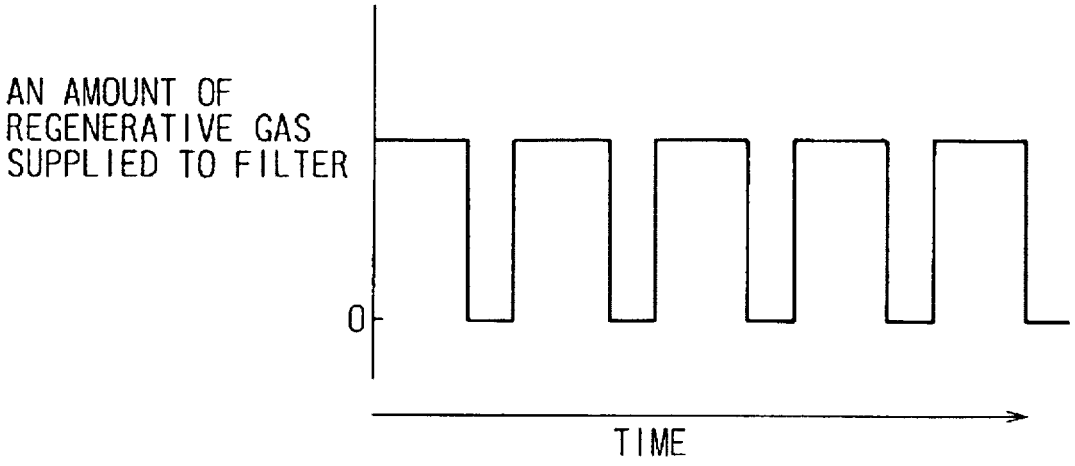
FIG. 23 is a time chart showing an amount of a regenerative gas supplied to the filter.

In above mentioned embodiments, a proper quantity of regenerative gas containing fuel is supplied to the filter, to burn particulates in the downstream part of a filter and then to burn particulates in the upstream part thereof. However, the supply of regenerative gas may be intermittent as shown in a time chart of FIG. 23. Therefore, when the regenerative gas is supplied, it surely transfers the combustion heat of particulates burned in each part of the filter to downstream thereof so that the temperature of each part of the filter is prevented from abnormally increasing. On the other hand, when the supply of regenerative gas is stopped, the combustion of particulates in the downstream part of the filter is easily propagated toward upstream to quickly burn particulates in the upstream part of the filter, to thereby shorten a filter regeneration time, i.e., a fuel supply time, and thus fuel is saved.

Figure 24:
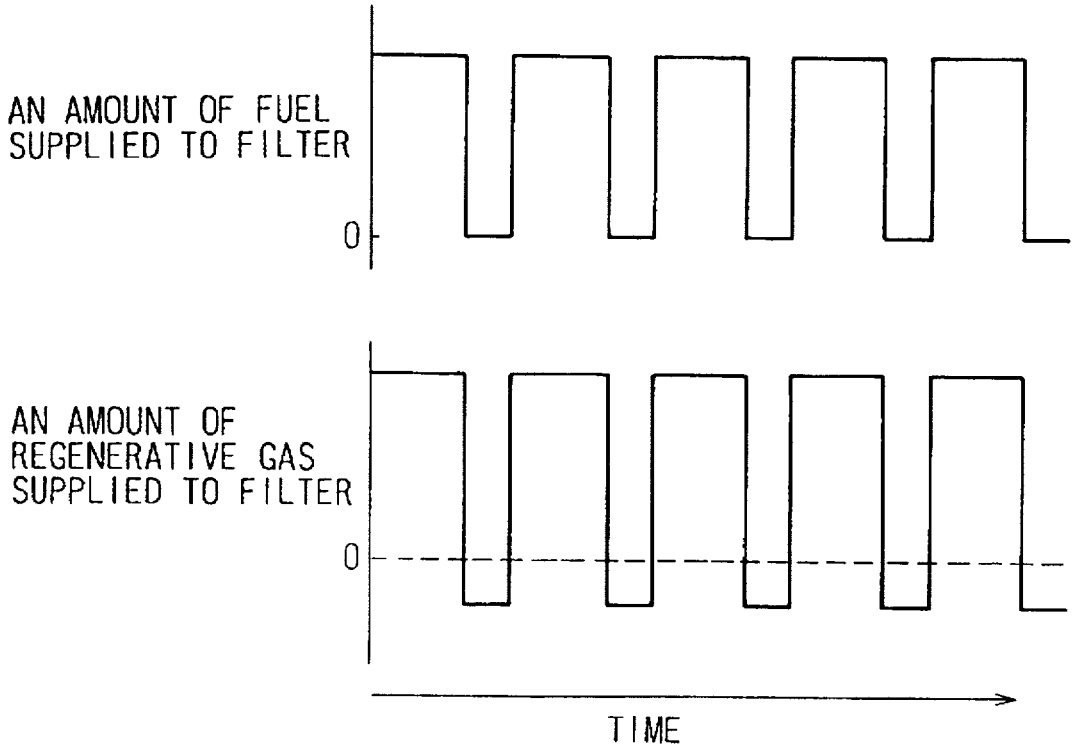
FIG. 24 is a time chart showing the amount of fuel and the amount of secondary air supplied to the filter.

In addition, when the supply of regenerative gas is stopped, the flow of the secondary air may be reversed and the supply of fuel may be stopped, as shown in FIG. 24. Therefore, the propagation of the combustion of particulates to the upstream part of the filter is accelerated and thus fuel is further saved.

Figure 25:
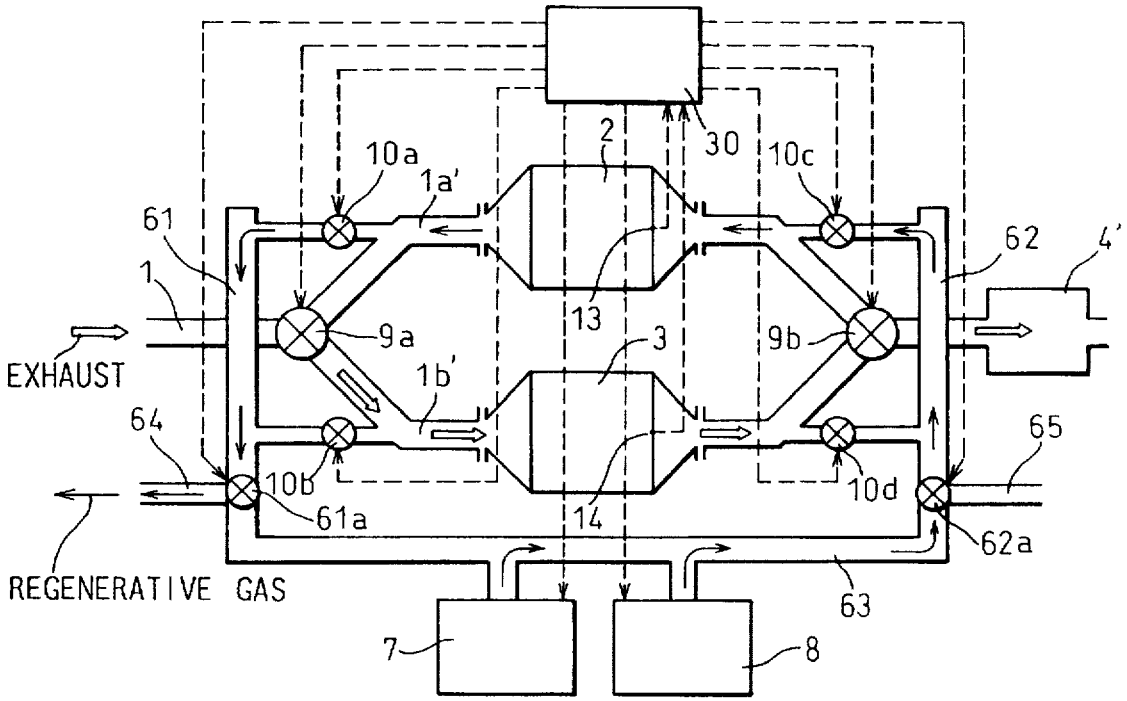
FIG. 25 is a sectional view schematically showing an exhaust purifier having a particulate collecting filter, according to the sixth embodiment of the present invention.

FIG. 25 is a sectional view schematically showing an exhaust emission control system having a particulate collecting filter according to a sixth embodiment of the present invention. Only the difference from the first embodiment will be explained. In this embodiment, first and second branch pipes 1*a*' and 1*b*' are joined together on a downstream side in the flow of exhaust gas and the joined portion is open to atmosphere, via a common muffler 4'.

The first and second branch pipes 1*a*' and 1*b*' have first and second filters 2 and 3, respectively. On the upstream side of the filters 2 and 3, the branch pipes 1*a*' and 1*b*' are connected to a first connection pipe 61. On the downstream side of the filters 2 and 3, the branch pipes 1*a*' and 1*b*' are connected to a second connection pipe 62. The first and second connection pipes 61 and 62 are connected to each other through a common pipe 63 to which a secondary air supply unit 7 and fuel supply unit 8 are connected. Shut-off valves 10*a* , 10*b*, 10*c*, and 10*d* are arranged at four joined portions between the first connection pipe 61 and the first and second branch pipes 1*a*' and 1*b*', and between the second connection pipe 62 and the first and second branch pipes 1*a*' and 1*b*', respectively. Changeover valves 9*a* and 9*b* are arranged at the branching and jointing points of the first and second branch pipes 1*a*' and 1*b*'. The changeover valves 9*a* and 9*b* are simultaneously changed to discharge exhaust from an exhaust pipe 1 to the common muffler 4' through one of the branch pipes.

The first connection pipe 61 is connected to a first discharge pipe 64 via a first connection pipe changeover valve 61*a*. The first connection pipe changeover valve 61*a* connects the branch pipe side of the first connection pipe 61 to the common pipe side of the first connection pipe 61, or to the first discharge pipe 64. The second connection pipe 62 is connected to a second discharge pipe 65 via a second connection pipe changeover valve 62*a*, which resembles the first connection pipe changeover valve 61*a*. Temperature sensors 13 and 14 are arranged downstream from the filters in the flow of exhaust.

Figure 26:
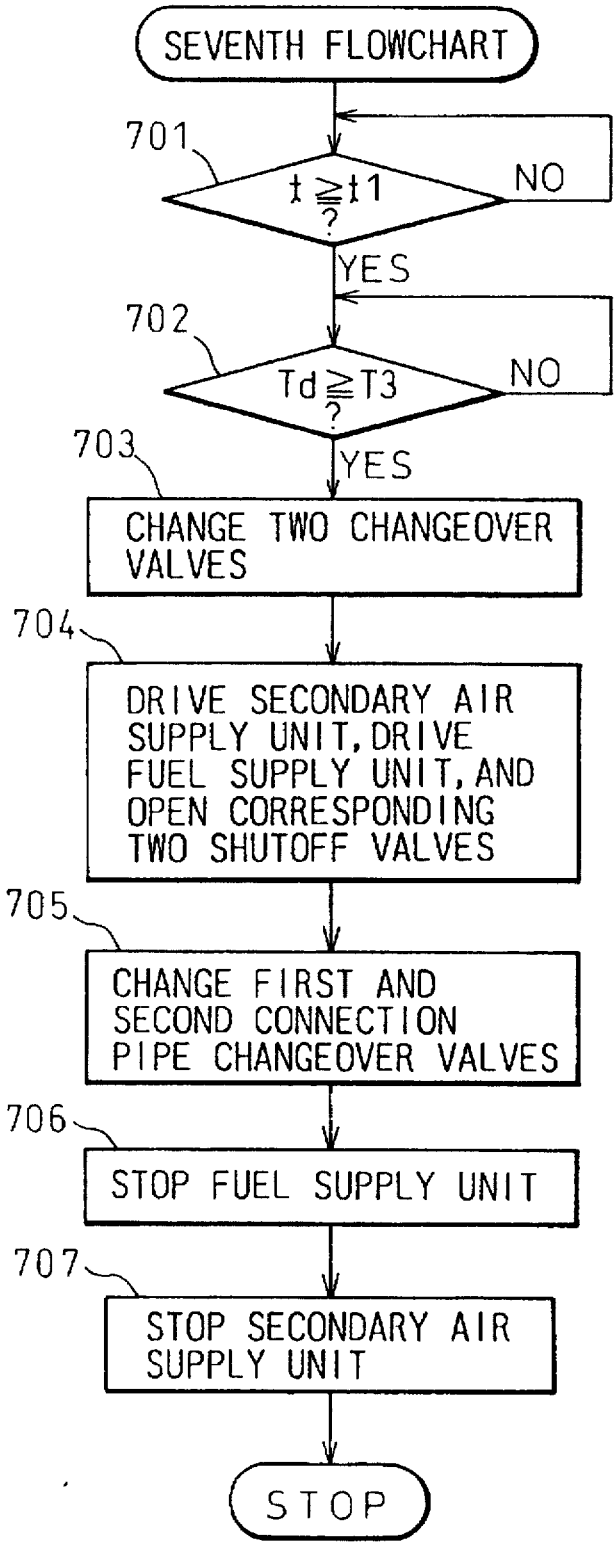
FIG. 26 is a seventh flowchart showing the steps of regenerating a filter.

FIG. 26 is a seventh flowchart showing the steps of regenerating the filters of the exhaust emission control system mentioned above. The flowchart will be explained on the assumption that the exhaust pipe 1 is connected to the first branch pipe 1*a* to let the first filter 2 collect the particulates in the exhaust.

At step 701 it is determined whether or not an engine operation time (t) is greater than a predetermined time (t1) in which a certain quantity of particulates are expected to be collected. If the determination is negative, there is no need to regenerate the first filter 2 at present, and the step 701 is repeated. If the determination is affirmative, it is close to the time to regenerate the filter, and step 702 is carried out.

At step 702 it is determined whether or not the temperature (Td) of the first filter 2, measured by the temperature sensor 13 arranged downstream from the first filter 2 in the flow of exhaust, is above a temperature (T3) that is somewhat greater than the activation temperature of a catalyst carried by the filter. When the engine is started from a cold state, the determination will be negative. In this case, the step 702 is repeated until it provides an affirmative answer due to the continuous operation of the engine. Thereafter, at step 703 the changeover valves 9*a* and 9*b* are simultaneously changed to connect the exhaust pipe 1 with the second branch pipe 1b'. Therefore, the second filter 3 collects particulates in exhaust, and the counter 50 for counting the engine operation time is reset to count an engine operation time (t) for the second filter 3 with the exhaust pipe 1 being connected with the second branch pipe 1b'.

Next, at step 704 the secondary air supply unit 7 and fuel supply unit 8 are driven to supply a proper quantity of regenerative gas consisting of a mixture of fuel and secondary air of proper ratio to the filter to properly burn particulates. At the same time, the shutoff valves 10a and 10c at the joints between the first branch pipe 1a' and the first and second connection pipes 61 and 62 are opened. At this time, the first connection pipe changeover valve 61a connects the branch pipe side of the first connection pipe 61 to the first discharge pipe 64, and the second connection pipe changeover valve 62a connects the branch pipe side of the second connection pipe 62 to the common pipe side of the second connection pipe 62.

Accordingly, the regenerative gas passes the second connection pipe 62, flows through the first filter 2 from the downstream part toward the upstream part thereof in the flow of exhaust, and is discharged through the first discharge pipe 64. In this way, the flow of the regenerative gas is opposite to the flow of exhaust at first. In this case, the temperature of the downstream part of the first filter 2 in the flow of exhaust is above the activation temperature of the catalyst, to cause fuel combustion to increase the temperature thereof and thus particulate combustion starts.

The combustion of the particulates is propagated from the downstream part of the filter toward the upstream part thereof in the flow of exhaust against the flow of the regenerative gas. If the regeneration of the filter is completed under this state, the temperature of the upstream part of the filter in the flow of exhaust will abnormally increase. To avoid this, it is estimated when the combustion of particulates reaches half of the longitudinal length of the filter. Then, at step 705 the first connection pipe changeover valve 61a is changed to connect the branch pipe side of the first connection pipe 61 to the common pipe side of the first connection pipe 61, and the second connection pipe changeover valve 62a is changed to connect the branch pipe side of the second connection pipe 62 to the second discharge pipe 65.

As a result, the regenerative gas passes the first connection pipe 61, flows through the first filter 2 from the upstream part toward the downstream part thereof in the flow of exhaust gas, and is discharged through the second discharge pipe 65. In this way, the flow of the regenerative gas is made identical to the flow of exhaust. Accordingly, the temperature of the upstream part of the first filter 2 is above the catalytic activation temperature, to cause fuel combustion and thus particulate combustion starts therein. The combustion heat is transferred by the regenerative gas toward the downstream part of the filter in the flow of exhaust gas. The time of the particulates burning up to half of the longitudinal length of the filter is estimated according to, for example, a fuel supply time, and when this estimated time comes, it is determined that the regeneration of the filter is complete. Then, at step 706 the fuel supply unit 8 is stopped, and at step 707 the secondary air supply unit 7 is stopped.

In the exhaust emission control system according to the sixth embodiment, particulate combustion propagates from the upstream part toward the downstream part of the filter in the flow of a regenerative gas. However, before the temperature of each part of the filter abnormally increases due to burning particulates from one side of the filter, the direction of the regenerative gas is reversed, thereafter particulates burn from the other side of the filter. Accordingly, in this embodiment the filter is properly regenerated like any one of the embodiments mentioned above. To further suppress an increase in the temperature of each part of the filter, the first and second connection pipe changeover valves 61a and 62a may be switched several times, to reduce the length of propagation of combustion of particulates.

Each of the embodiments mentioned above employs an engine operation time to determine the time of regenerating a filter. Instead, it is possible to employ the pressure of exhaust on the downstream side of a filter in an exhaust passage, the pressure difference of exhaust between both ends of a filter, or a running distance. Although in each of the embodiments a filter is provided with a catalyst, this does not limit the present invention. It is possible to directly burn particulates by controlling the temperature of each part of a filter according to the principle of the present invention. A combustion helping agent may be applied to a filter. The secondary air is usually the atmosphere. The secondary air may be exhaust that contains unburned oxygen if the temperature conditions are met.

Although the invention has been described with reference to specific embodiments thereof, it should be apparent that numerous modifications can be made thereto by those skilled in the art, without departing from the basic concept and scope of the invention.

I claim:

1. A method for regenerating a particulate collection filter by the use of a regenerative gas comprising:

a step for causing particulate combustion in only the downstream part of said filter in the flow of said regenerative gas; and a step for causing said particulate combustion in the downstream part of said filter to propagate toward the upstream part of said filter in the flow of said regenerative gas, wherein said flow of said regenerative gas is in a direction from said upstream part of said filter towards said downstream part of said filter.

2. An exhaust emission control system with a particulate collection filter regenerated by the use of a regenerative gas comprising:

determining means for determining when the filter must be regenerated;

partial combustion means for causing particulate combustion in only the downstream part of said filter in the flow of said regenerative gas when the filter must be regenerated; and combustion propagating means for causing particulate combustion in the downstream part of said filter to propagate toward the upstream part of said filter in the flow of said regenerative gas, wherein said flow of said regenerative gas is in a direction from said upstream part of said filter towards said downstream part of said filter.

3. An exhaust emission control system according to claim 2, wherein said filter carries a catalyst, wherein said partial combustion means has filter temperature control means for controlling said filter temperature such that temperature in only said downstream part of said filter becomes above the activation temperature of the catalyst when said filter must be regenerated and a fuel supply means for supplying fuel to said filter when said temperature in only said downstream part of said filter becomes higher than the activation temperature of the catalyst.

4. An exhaust emission control system according to claim 2, wherein said partial combustion means has a secondary air supplying means for supplying secondary air to said filter, as the regenerative gas, when said filter must be regenerated so that only the upstream part of said filter in the flow of said secondary air is cooled, and a fuel supply means for supplying fuel to said filter when temperature in only the downstream part of said filter in the flow of said secondary air becomes above a temperature at which particulates can burn.

5. An exhaust emission control system according to claim 2, wherein said partial combustion means has a heating means arranged on the downstream side of said filter in the flow of the regenerative gas and an activating means for activating said heating means when said filter must be regenerated.

6. An exhaust emission control system according to claim 2, wherein said regenerative gas includes fuel, wherein said partial combustion means has a regenerative gas supplying means for supplying a large amount of regenerative gas to said filter when said filter must be regenerated, such that particulate combustion does not occur in only the upstream part of said filter in the flow of the regenerative gas, and wherein said combustion propagating means has regenerative gas reduction means for reducing the amount of regenerative gas supplied by said regenerative gas supply means, such that particulate combustion occurs in the upstream part of said filter in the flow of the regenerative gas.

7. An exhaust emission control system according to claim 2, wherein said partial combustion means has a fuel mixing means for mixing a small amount of fuel with the regenerative gas when said filter must be regenerated such that particulate combustion does not occur in the upstream part of said filter in the flow of the regenerative gas and wherein said combustion propagating means has fuel increasing means for increasing the amount of fuel mixed with the regenerative gas, by said fuel mixing means, to an amount of fuel adapted to particulate combustion.

8. An exhaust emission control system according to claim 2, wherein said partial combustion means has a fuel supplying means for directly supplying fuel to the downstream part of said filter in the flow of regenerative gas when said filter must be regenerated and a secondary air supplying means for supplying secondary air to said filter as the regenerative gas after the fuel is supplied to said filter by said fuel supplying means, and wherein said combustion propagating means has a fuel mixing means for mixing fuel with the secondary air after the secondary air is supplied to said filter by said secondary air supplying means.

9. An exhaust emission control system according to claim 2, wherein said partial combustion means has a fuel supplying means for directly supplying fuel to the downstream part of said filter in the flow of regenerative gas when said filter must be regenerated and fuel mixing means for mixing a small amount of fuel with the regenerative gas after the fuel is supplied to said filter by said fuel supplying means, such that particulate combustion does not occur in the upstream part of said filter in the flow of the regenerative gas, and wherein said combustion propagating means has a fuel increasing means for increasing the amount of fuel mixed with the regenerative gas by said fuel mixing means to an amount of fuel adapted to particulate combustion.

10. An exhaust emission control system with a particulate collection filter regenerated by the use of a regenerative gas comprising:

determining means for determining when the filter must be regenerated;

partial combustion means for causing particulate combustion in only the downstream part of said filter in the flow of said regenerative gas when the filter must be regenerated; and combustion propagating means for causing said particulate combustion in the downstream part of said filter to propagate toward the upstream part of said filter in the flow of said regenerative gas, wherein said filter carries a high-temperature-active catalyst in the upstream part of said filter in the flow of the regenerative gas and a low-temperature-active catalyst in the downstream part of said filter, and wherein said partial combustion means has fuel supplying means for supplying fuel to said filter when said filter must be regenerated and only said low-temperature-active catalyst is active.

11. A method for regenerating a particulate collection filter by the use of a regenerative gas comprising:

a step for supplying the regenerative gas to one end of said filter so that particulate combustion propagates from said one end toward the downstream part of said filter in the flow of the regenerative gas; and a step for reversing the supply of the regenerative gas to the other end of said filter so that particulate combustion propagates from said other end toward the downstream part of said filter in the flow of the regenerative gas before the temperature in any part of said filter becomes higher than a predetermined temperature due to heat produced by the particulate combustion.

12. An exhaust emission control system with a particulate collection filter regenerated by the use of a regenerative gas comprising:

a determining means for determining when the filter must be regenerated;

a regenerative gas supplying means for supplying a regenerative gas to one end of said filter when the filter must be regenerated such that particulate combustion propagates from said one end toward the downstream part of said filter in the flow of the regenerative gas; and reversing means for reversing the supply of the regenerative gas to the other end of said filter such that particulate combustion propagates from said other end toward the downstream part of said filter in the flow of the regenerative gas before temperature in any part of said filter becomes higher than a predetermined temperature due to heat produced by the particulate combustion.

* * * * *